US005626333A

United States Patent [19]

Chung et al.

[11] Patent Number: 5,626,333

[45] Date of Patent: May 6, 1997

[54] SORTER, SHEET JOGGING DEVICE, STAPLING DEVICE, AND STAPLING SORTER USING THOSE DEVICES FOR COPYING MACHINE

[75] Inventors: Jae H. Chung; Yeon K. Jung; Seung K. Noh, all of Seoul, Rep. of Korea

[73] Assignee: Sindo Richo Co., Ltd., Seoul, Rep. of Korea

[21] Appl. No.: 489,404

[22] Filed: Jun. 12, 1995

[30] Foreign Application Priority Data

Jan. 12, 1995 [KR] Rep. of Korea ..... 95-448

[51] Int. Cl.[6] ..... B65H 39/02; B65H 39/10

[52] U.S. Cl. ..... 270/58.16; 270/58.17; 270/58.19; 270/58.12; 271/293

[58] Field of Search ..... 271/293, 294, 271/223, 224; 270/58.14, 58.15, 58.16, 58.17, 58.19, 58.08, 58.11, 58.12, 58.13; 355/324

[56] References Cited

U.S. PATENT DOCUMENTS

| | | | |
|---|---|---|---|
| 3,685,712 | 8/1972 | Turner et al. . | |
| 3,721,435 | 3/1973 | Zanders . | |
| 3,788,640 | 1/1974 | Stemmle | 270/58 X |
| 3,848,868 | 11/1974 | Stemmle . | |
| 3,884,408 | 5/1975 | Leiter et al. . | |
| 3,938,802 | 2/1976 | Hartman | 271/220 |
| 3,973,769 | 8/1976 | Cross et al. . | |
| 3,994,427 | 11/1976 | Ganatsiou . | |
| 3,995,748 | 12/1976 | Looney . | |
| 4,083,550 | 4/1978 | Pal . | |
| 4,134,672 | 1/1979 | Burley et al. . | |
| 4,203,587 | 5/1980 | Kishi et al. | 271/293 |
| 4,214,746 | 7/1980 | Redding et al. | 271/293 X |
| 4,253,656 | 3/1981 | Landa . | |
| 4,281,920 | 8/1981 | Cross . | |
| 4,295,733 | 10/1981 | Janssen et al. . | |
| 4,328,963 | 5/1982 | DuBois et al. | 271/293 |
| 4,332,377 | 6/1982 | DuBois et al. | 271/293 |
| 4,337,936 | 7/1982 | Lawrence . | |
| 4,343,463 | 8/1982 | Lawrence . | |
| 4,376,529 | 3/1983 | George et al. . | |
| 4,397,461 | 8/1983 | DuBois et al. | 271/293 |
| 4,466,608 | 8/1984 | BuBois et al. | 271/293 |
| 4,466,609 | 8/1984 | Lawrence | 271/293 |
| 4,497,478 | 2/1985 | Reschenhofer et al. . | |
| 4,566,782 | 1/1986 | Britt et al. . | |
| 4,621,803 | 11/1986 | Johdai et al. | 271/293 |
| 4,627,706 | 12/1986 | Takahashi et al. . | |
| 4,681,310 | 7/1987 | Cooper . | |
| 4,684,241 | 8/1987 | Acquaviva . | |
| 4,709,915 | 12/1987 | Ishikawa et al. . | |
| 4,762,312 | 8/1988 | Ushirogata . | |
| 4,778,171 | 10/1988 | Hidaka | 271/293 |
| 4,787,616 | 11/1988 | Sasaki et al. . | |
| 4,826,421 | 5/1989 | Asano et al. | 271/223 X |

(List continued on next page.)

FOREIGN PATENT DOCUMENTS

| | | | |
|---|---|---|---|
| 63-295371 | 1/1988 | Japan . | |
| 3-102070 | 4/1991 | Japan | 271/221 |

*Primary Examiner*—Hoang Nguyen

[57] ABSTRACT

This invention provides a tray shifting type sorter comprising a number of trays having a couple of trunnions at the rear ends of both lateral sides, respectively and a couple of drive wheel assemblies oppositely installed on both side walls of the sorter. The drive wheel assembly includes a cam wheel shifting the trays and a supplementary wheel supporting the trays over the drive wheel assembly. The invention further provides a sheet jogging device for aligning the copy sheets with an alignment rod using a wire as the power transmission apparatus and equipped with tension change apparatus to loosen the wire, so that the drive apparatus is prevented from being overloaded by the continuous contact between the alignment rod and the copy sheets. The invention further provides a stapling device for stapling the aligned copy sheets, which uses the drive apparatus for a sheet discharging roller without a separate drive apparatus and is equipped with a power transmission apparatus which can transmit torque from the drive apparatus selectively only to the sector gear when stapling.

26 Claims, 27 Drawing Sheets

U.S. PATENT DOCUMENTS

| | | | |
|---|---|---|---|
| 4,872,663 | 10/1989 | Latone | 271/293 X |
| 4,880,223 | 11/1989 | Yamazaki et al. | 271/293 |
| 4,928,941 | 5/1990 | Uto et al. | 270/53 |
| 4,930,761 | 6/1990 | Naito et al. | 270/53 |
| 4,946,152 | 8/1990 | Ishikawa et al. | 270/58.15 |
| 5,014,091 | 5/1991 | Koike et al. | 355/324 X |
| 5,054,766 | 10/1991 | Seki et al. | 271/221 |
| 5,104,106 | 4/1992 | Shido et al. | 270/53 |
| 5,152,511 | 10/1992 | Shido et al. | 270/53 |
| 5,186,445 | 2/1993 | Nakanishi et al. | 270/58.14 |
| 5,201,425 | 4/1993 | Roux et al. | 271/224 X |
| 5,236,189 | 8/1993 | Ikoma | 271/293 X |
| 5,255,902 | 10/1993 | Coombs | 270/53 |
| 5,330,170 | 7/1994 | Uotani et al. | 270/58.08 |
| 5,344,131 | 9/1994 | Lawrence | 270/58.17 |
| 5,348,279 | 9/1994 | Lambregts et al. | 270/58.08 |
| 5,447,298 | 9/1995 | Watanabe et al. | 270/58.11 |

SORTER, SHEET JOGGING DEVICE, STAPLING DEVICE, AND STAPLING SORTER USING THOSE DEVICES FOR COPYING MACHINE

BACKGROUND OF THE INVENTION

1. Field of the invention

This invention relates to a sorter, a sheet jogging device and a stapling device, in particular a compact type sorter, which can shift trays sequentially and vertically up and down with minimal power by using a disk cam type wheel having a groove crossing the disk surface in a curved line, an improved sheet jogging device which does not overload a drive means and a stapling device which is operated without a separate drive means therefor.

2. Information Disclosure Statement

There is an increasing need for a compact, speedy and low-noise sorter for a copying machine (automatic sheet sorting device) and a multi-function sorter which can further execute such various functions as jogging and stapling the collated sheets in the sorter.

The above needs may be divided into two functional categories. One is an effective automatic sorting mechanism of copy sheets, and the other is a post-sorting method of handling the sorted sheets, that is jogging and stapling.

Sheet sorting is necessary to produce multiple sets of copies of multiple page documents. It requires transfer means and plural trays to sort and accommodate the copy sheets into collated sets. In order to meet this functional requirement and further requirements of simplicity of operation and compact size, various sorting machines have been devised in which a plurality of trays are stacked in a compact or closely spaced relation reducing the space occupied by the trays while sorting the copy sheets between adjacent trays.

Among those sorters a shiftable tray or bin type (the "Tray Shifting Type") sorter is especially noteworthy. It discharges copy sheets successively to trays shifted vertically up and down and spaced widely enough in the outlet for easy entry of the copy sheets between adjacent trays. Every Tray Shifting Type sorter essentially includes two functions. One function is shifting the trays vertically from a first closely spaced relation at one side of the sheet outlet to a second closely spaced relation at the other side of the sheet outlet while the other function is widening the gap between adjacent trays at the outlet to accommodate sheet entry.

The two typical models of Tray Shifting Type are a sorter using a cylindrical cam having a helical groove on its circumferential lateral surface and a sorter using a notched disk cam having one or two slots radially and functioning as a Geneva movement.

U.S. Pat. No. 4,337,936 (Jul. 6, 1982) and U.S. Pat. No. 4,343,463 (Aug. 10, 1982) granted to Mr. Frederick J. Lawrence, disclosed a Tray shifting Type sorter using a pair of cylindrical cams. In Lawrence's sorter, a couple of cylindrical cams having a helical groove on their circumferential surfaces are installed in opposite sides at the sheet outlet and trays are stacked at the upper side of the cylinder cams in their first closely spaced relation. The tray has a pair of trunnions on the opposite lateral sides, which engage the cylindrical cams. The trays are moved downward while the trunnions pass the helical grooves of the cylindrical cams successively when the cylindrical cam is revolving. The tray passing the cylindrical cam is pivotally and widely spaced apart from the upper stacked trays and a copy sheet is discharged on the tray by a transfer roller of a copying machine during the pivotal movement of the tray. The trays are stacked at the lower side in their second closely spaced relation after accommodating the copy sheets successively.

Another U.S. Pat. No. 4,466,609 (Aug. 21, 1984) granted to Mr. Lawrence, disclosed a cylindrical cam type sorter which shifts trays up and down by installing a couple of spaced apart cylindrical cams on each side of the outlet in order to shift the trays in parallel rather than in a pivotal manner.

In all the Lawrence's sorters using cylindrical cams, the cylindrical cams are generally rotated by the revolution of cam shafts fixed in the cylindrical cams, which are supported by locational bearings and driven through belts by a motor located at the upper center of the sorter. The movement of the trays according to the mechanism is smooth and continuous since the trunnion flows through the rotating helical groove as if it is rolling down a slope continuously and linearly. However the cylindrical cams and the upper installed motor require relatively large spaces in the side and upper parts of the sorter, and therefore they limit compactness of the sorter.

U.S. Pat. No. 4,328,963 (May 11, 1982), U.S. Pat. No. 4,332,377 (Jun. 1, 1982), U.S. Pat. No. 4,397,461 (Aug. 9, 1983), and U.S. Pat. No. 4,466,608 (Aug. 21, 1984) granted to R. Clark DuBois and John C. Hamma disclosed another Tray Shifting Type sorter using disk type cams. Their basic approach provides a disk type cam having one or two notched slots radially on each side of the outlet. The disk cam receives a trunnion of a tray in the slot and rotates to widen the tray spacing at the outlet during their Geneva movement.

This sorting mechanism greatly simplified the drive device as a center shaft connected both disk cams together in their centers and it greatly reduced the installation space required for the cams and motor by installing the shaft and the motor inside the sorter and by attaching the relatively thin disks on the side walls of the sorter. Therefore the sorter of DuBois et al is permitted a relatively simple and compact sorter. In the sorting mechanism of DuBois et al, a pair of trunnions of a tray are compressed by spring or dropped by weight into the slots of the disk cam for widening the spacing of the adjacent tray at the outlet and shifting the trays from a first closely spaced relation at one side of the disk cam to a second closely spaced relation at the other side of the disk cam. According to the above mechanism, the trays are shifted upwardly or downwardly with the trunnions being received in the slots of the disk cams, the tray is pivotally widened by rotation of the disk cam at the outlet and a copy sheet enters through such widened gap on the tray, and then the disk cam discharges the trunnion in order to stack the trays at the other side of the outlet.

However, the DuBois and Hamma sorter is noisy because of the impact between the trunnion and the slot of the disk cam, when slots of the disk cams approach, accommodate, and discharge trunnions. Furthermore, the driving operation is not continuous and smooth because the disk cams endure different loads in a rotation according to whether they accommodate the trunnions therein. Moreover, the motion to accommodate the trunnion into the slot of the disk cam requires additional time, so that the DuBois and Hamma sorter can not be adapted to a high-speed copying machine.

In every Tray Shifting Type sorter, the spacing between trays is a major factor which decides the number of copy sheets that can be accommodated in a tray; and the spacing is defined by the diameter of a trunnion. Further, recently developed sorters have adopted guide pins together with the trunnions, which are formed on front edges of a tray and are captured in guide holes of a couple of separate guide members for trays. Guide members are attached opposite each lateral surface of the assembled trays and have a plurality of guide holes which support and guide the guide pins in order to keep the front ends of the trays spaced apart as wide as the rear ends of the trays.

In the prior trays, a guide pin has a diameter smaller than that of a trunnion and a guide hole has width slightly larger than the diameter of the guide pin. On assembling the trays and the guide member in a sorter, generally the trays are mounted in a sorter body and then a pair of guide members are attached to the subassembled trays. However, the operation for assembling the guide member to the trays, is laborsome since the spacing of the guide holes is different from that of stacked guide pins. Further, the guide member may fall out of the guide pins as a result of accident or vibrations during sorting operation since the guide pins are loosely fitted into the guide holes.

Accompanying the development of sorting mechanisms, multi-function sorters have been developed to align and staple the sorted sheets. Multi page documents are generally stapled after copying the documents, and therefore it is desirable to staple the copy sheets on a sorter.

The conventional jogging device, which assembles the collated sorted copy sheets into aligned sets prior to stapling, uses a pivot arm which is activated by a driving gear and a driven gear, as suggested in U.S. Pat. No. 5,090,673. However, the device has shortcomings in that the drive means often is overloaded and noisy during operation.

The structure and problems of a sheet jogging device according to the prior art are as follows:

FIG. 16A is a perspective view of a sheet jogging device according to the prior art and FIG. 16B is a plan view of FIG. 16A showing a tray only among a number of trays for illustrative convenience.

A number of trays 201 installed at an outlet part 200 of a copying machine are moved upward and downward along front and rear posts 205F and 205R connecting an upper frame 203 and a lower frame 204 of a tray housing 200. The front flanks of the tray 201 contact and slide along the front posts 205F, respectively, as the rear flanks of the tray 201 are coordinated with the rear posts 205R (for illustrative convenience, only one front post and one rear post are shown as a whole and the other ones are partially cut off in FIG. 16A). A slot 205S is formed vertically in each rear post 205R, and a tray 201 has a pair of rollers 201R opposite each rear flank. Therefore, as the rollers 201R move upward and downward along the slots 205S, the tray 201 can slide vertically along the rear posts 205R. The tray 201 has an arc-shaped guide hole 201H therein.

A drive means 206 and a driving gear 207 mounted on the top of the drive means 206 are located at the lower frame 204 and a driven gear 208 is geared with the driving gear 207. A shaft for the driven gear 208 and a rotational shaft 209 are formed as integral parts and coaxially mounted between the upper frame 203 and the lower frame 204, and an upper arm 211 and a lower arm 212 are fixed to the upper end and to the lower end of the shaft 209, respectively. An alignment rod 210 in parallel with the rotational shaft 209 is fixed to the front ends of the upper arm 211 and the lower arm 212 therebetween. The alignment rod 210 is installed into the guide holes 210H of the trays 201. Item 290 in FIG. 2 illustrates a stapler unit.

When copy sheets are distributed on the tray 201 ("X" position in FIG. 16B) from the outlet of a copying machine the driving gear 207 and the driven gear 208 are rotated by the drive means 206 to align the copy sheets. In accordance with a rotation of the driven gear 208, the rotational shaft 209 revolves and therefore the upper arm 211 and the lower arm 212 fixed to the rotational shaft 209 move curvilinearly pivoting on the shaft 209 in the guide hole 210H of the tray 201. The action moves and aligns the copy sheets to "Y" position of FIG. 16B at the same time. Then the aligned copy sheets are generally stapled by a stapler unit 290.

However, the following problems occur during the operation of the sheet jogging device as described above.

First, when the alignment rod contacts the copy sheets for alignment, the contact force imposes loads to the drive means, which sometimes causes breakdown of the drive means as well as consuming excess amount of energy.

Second, the loads acting to the drive means are not uniform in accordance with the sizes of the copy sheets such as A4, B5 since the alignment bar contacts the copy sheets in different locations.

Third, as the driving mechanism for the sheet jogging device adopts the engaged gears, they cause a lot of noises during the operation.

On the other hand, as a stapler used for the prior stapling device in a sorter generally needs a separate drive means therefor, it is regarded as an obstacle to providing a compact and economic stapling sorter.

It is the primary object of this invention to provide a compact sorter using a disk type cam which can be operated continuously and with uniform load.

Another object of the invention is to provide a disk cam type sorter which can be operated smoothly and silently in high-speed sorting.

A further object of this invention is to provide an economical sorter capable of operating with low power consumption.

Another object of this invention is to provide improvements in a tray and a guide member which can be easily and securely matable each other and also provide an assembly type tray in which guide pins and/or trunnions are comprised of separate members to be mated with a tray member.

An additional object of this invention is to provide a sheet jogging device in which a drive means can be protected from overload by using a tension change means and which can decrease noise by using a wire as power transmission means for jogging member.

Another object of this invention is to provide a stapling device in which a stapler assembly can be easily attached and detached in a sorter and which is driven by the drive motor for discharging the sheets at outlet without an separate motor.

Finally, this invention aims to provide a more compact and effective stapling sorter.

SUMMARY OF THE INVENTION

In order to achieve the above objects, this invention provides an improved Tray Shifting Type sorter using double disk cams, which comprises trays having a pair of trunnions opposite each rear flank of the trays, and double disk cams comprising a cam wheel having a passage slot in a surface through which a trunnion passes by rotation of the wheel and a supplementary wheel having at least a pair of cam surfaces radially in opposite directions to support and allow the other trunnion of a tray to pass through or around the wheel, wherein the double disk cams are attached on both side walls of the sorter, respectively and are coordinated to shift the trays.

This invention also provides an improved tray having a boss portion in the root of a guide pin, the diameter of which is equal to the center line spacing of guide holes of a guide member and having an enlarged portion at the free end of the guide pin, which is larger than the guide hole, and a guide member having an enlarged hole at the lower end of the guide hole in order to receive the enlarged portion of the guide pin.

This invention also provides an assembly type tray comprising a tray member and separate guide pin portions and trunnion portions to be mated with the tray member.

Further, this invention provides a sheet jogging device comprising a first driven pulley and a second driven pulley which are connected to a driving pulley via power transmission means, a tension change means pivoting the first driven pulley to change tension of the power transmission means and an alignment rod fixed to the power transmission means moving in a tray hole, wherein the drive means moves the alignment rod to align the collated copy sheets and the contact between the rod and the sheets urges the first driven pulley pivoted so that the tension change means relaxes the power transmission means in order to protect the drive means from overloading.

This invention further provides a stapling device which staples the aligned sheets, comprising a stapler assembly, a guide plate rotating in a predetermined direction on which the stapler assembly is mounted, a driven gear fixed with the guide plate to rotate the stapler assembly, the driven gear being operated by a drive means for the discharge roller, a rotation switching means which connects the driven gear to the drive means and selectively transmit torque of the driving shaft to the driven gear and a return means returning the rotated driven gear to the initial position, wherein on completing the alignment operation, the power transmission means transmits torques of the drive means to the driven gear to rotate the guide plate toward the trays so that the stapler assembly staples the aligned copy sheets.

Finally, this invention provides a stapling sorter comprising the sorter, the sheet jogging device and the stapling device as mentioned above.

BRIEF DESCRIPTION OF THE DRAWINGS

Other objects and advantages of the present invention will be understood by reading the detailed explanation of embodiments with reference to the accompanying drawings in which.

DETAILED DESCRIPTION OF PREFERRED EMBODIMENTS

Figure 1:
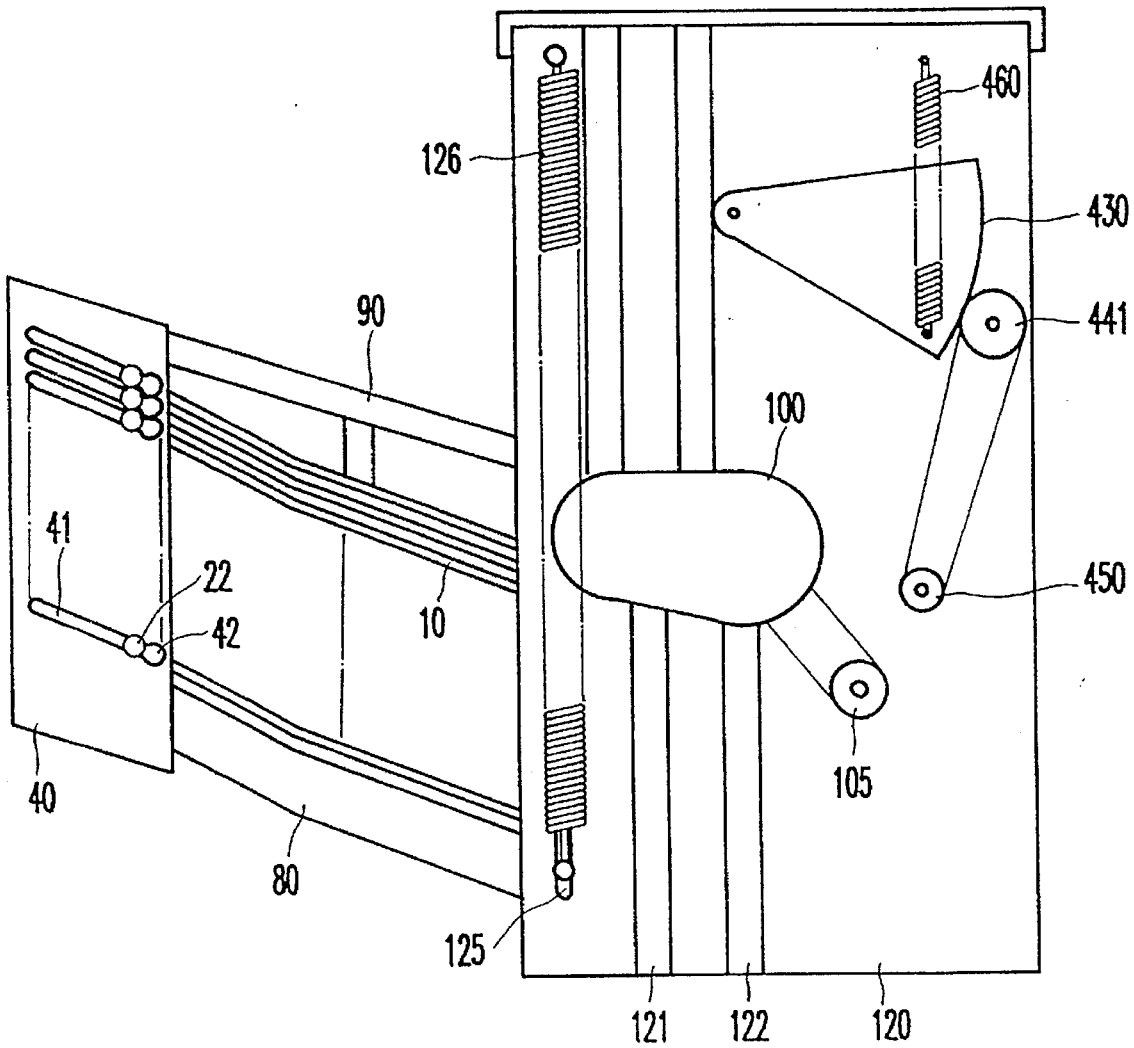
FIG. 1 is a side elevational view of a sorter according to the present invention.
Figure 2:
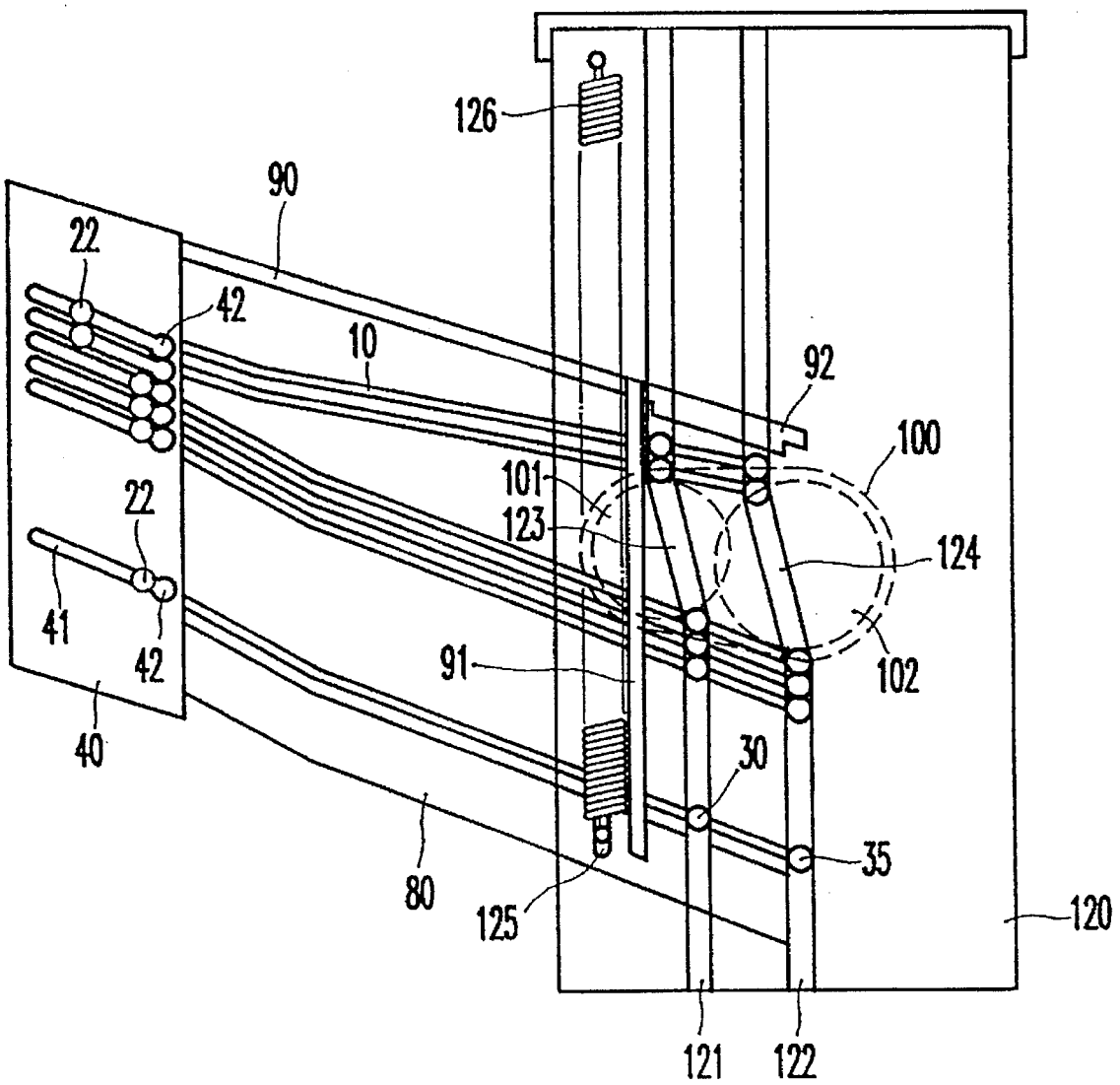
FIG. 2 is a side elevational view of a sorter, showing the operational relation between trunnions and double disk cams according to the present invention.
Figure 3:
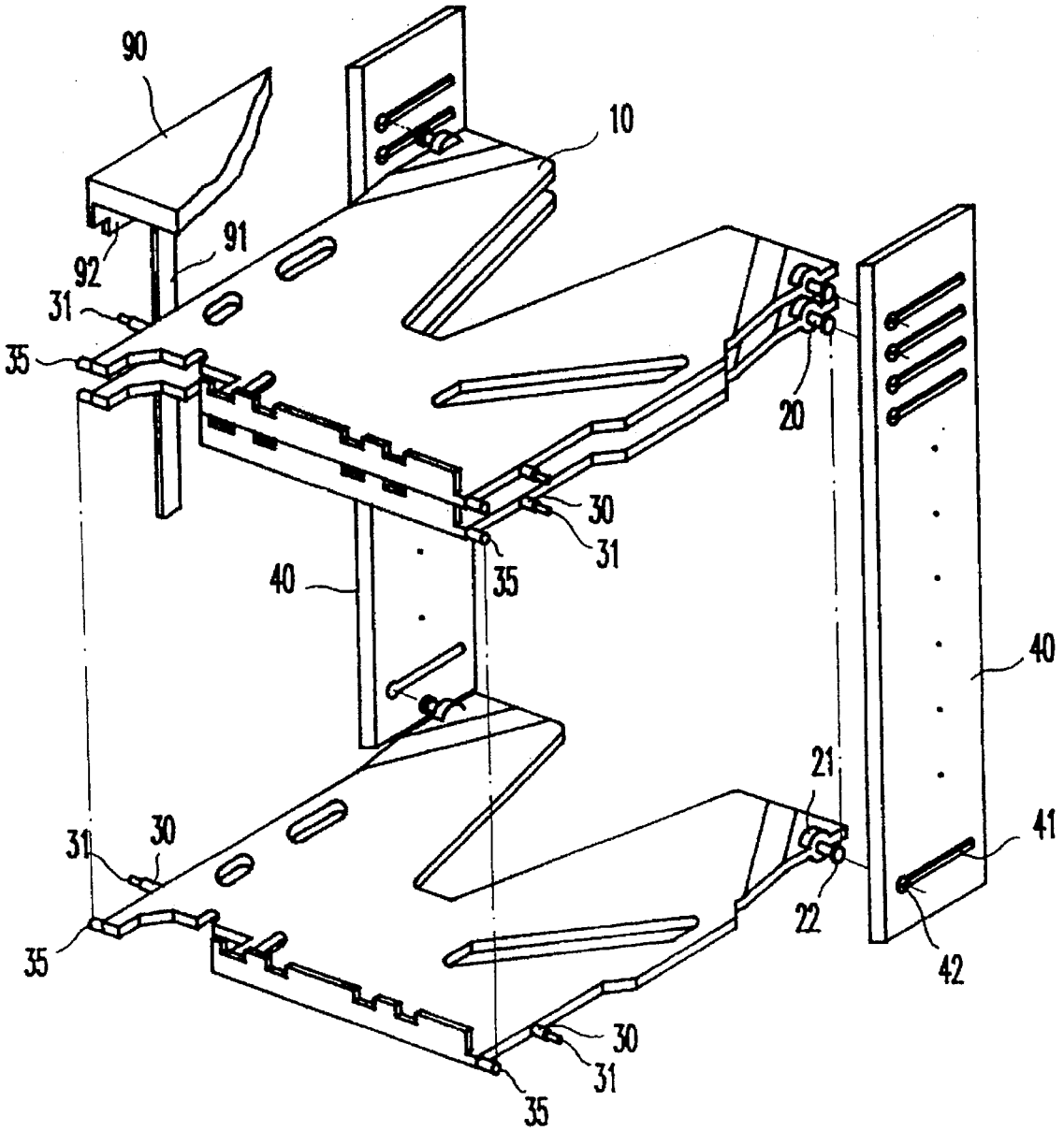
FIG. 3 is an exploded perspective view of a tray and a tray guide member according to the present invention.

FIGS. 1 and 2 show side elevational views of the structure of a sorter embodying the invention, and FIG. 3 shows trays 10 and tray guide members 40 in an exploded perspective view in which the trays 10 and the guide holes 41 of the guide members 40 are shown, some in plural form for illustrative convenience.

Referring to FIGS. 1 and 3, a sorter according to the invention comprises a plurality of trays 10 stacked vertically in closely spaced relationship on a tray supporter 80, a pair of drive wheel assemblies 100 including a cam wheel 101 and a supplementary wheel 102 respectively used to shift the trays up and down, a pair of springs 126 ascending the trays 10 located below the driving wheel assembly 100 along vertical holes 125, a tray cover 90 having connection members 91 and restraining members 92, and sorter side walls 120 having a pair of parallel and vertical slots 121 and 122 and a vertical hole 125 respectively.

Referring to FIG. 3, the tray 10 according to the invention includes a guide pin 20 which moves forward and backward along a guide hole 41 after being admitted into a enlarged circular hole 42 at the lower end of the guide hole 41 of guide member 40 and a couple of trunnions 30 and 35 which cooperate with the drive wheel assemblies 100. The trunnions comprise a first trunnion 30 which is admitted in and moves along the passage slot of the cam wheel 101 and a second trunnion 35 which is supported by the supplementary wheel 102 in contact with the cam surface thereof. The first trunnion 30 has an extension end 31 to be inserted into the slot of the cam wheel 101.

The guide pins 20 have an enlarged boss 21 at the end that connects with the trays 10, which are stacked in contact with each other to allow the spacing between guide pins 20 in accord with the centerline spacing of guide holes 41 of the guide member 40, and an enlarged circular portion 22 at the free end of guide pin 20 which is admitted into the insertion hole 42 of the guide hole 41 and prevents the guide pin 20 from falling out of the guide member 40 after assemblying. Therefore, the guide members 40 can be easily attached to the guide pins 20 of the stacked trays 10 because the spacing between guide pins 20 in the boss stacked condition are the same as those of centerlines of the guide holes 41 of the guide member 40. And the guide pin 20 can not be disconnected from the guide member 41 by accident since the circular enlarged portion 22 once admitted in the circular insertion hole 42 of the guide member 40 is moved only within the guide hole 41 not reaching the insertion hole 42.

Referring to FIG. 2, the guide pin 20 is located at the upper part of guide hole 41 when trays 10 are stacked on the drive wheel assembly 100 at one side of the outlet in a second closely spaced relation. The guide pin 20 is located at the lower part of the guide hole 41 but located above the circular hole 42 when they are stacked on a tray supporter 80 at the other side of the outlet in a first closely spaced relation. The guide pin 20 is moved from the lower position to the upper position during a pivot movement of a tray according to the operation of the drive wheel assembly 100. Therefore, guide pin 20 will not descend to the insertion hole 42 of the guide member 40 during operation, so that the trays 10 can be protected from being disconnected from the guide member 40.

Referring to FIGS. 4A to 4F, the tray can be manufactured as an assembly type tray 50 instead of the tray 10 to allow guide pins 20 and trunnions 30 and 35 to be changed when guide pins and trunnions are damaged or broken.

Figure 4A:
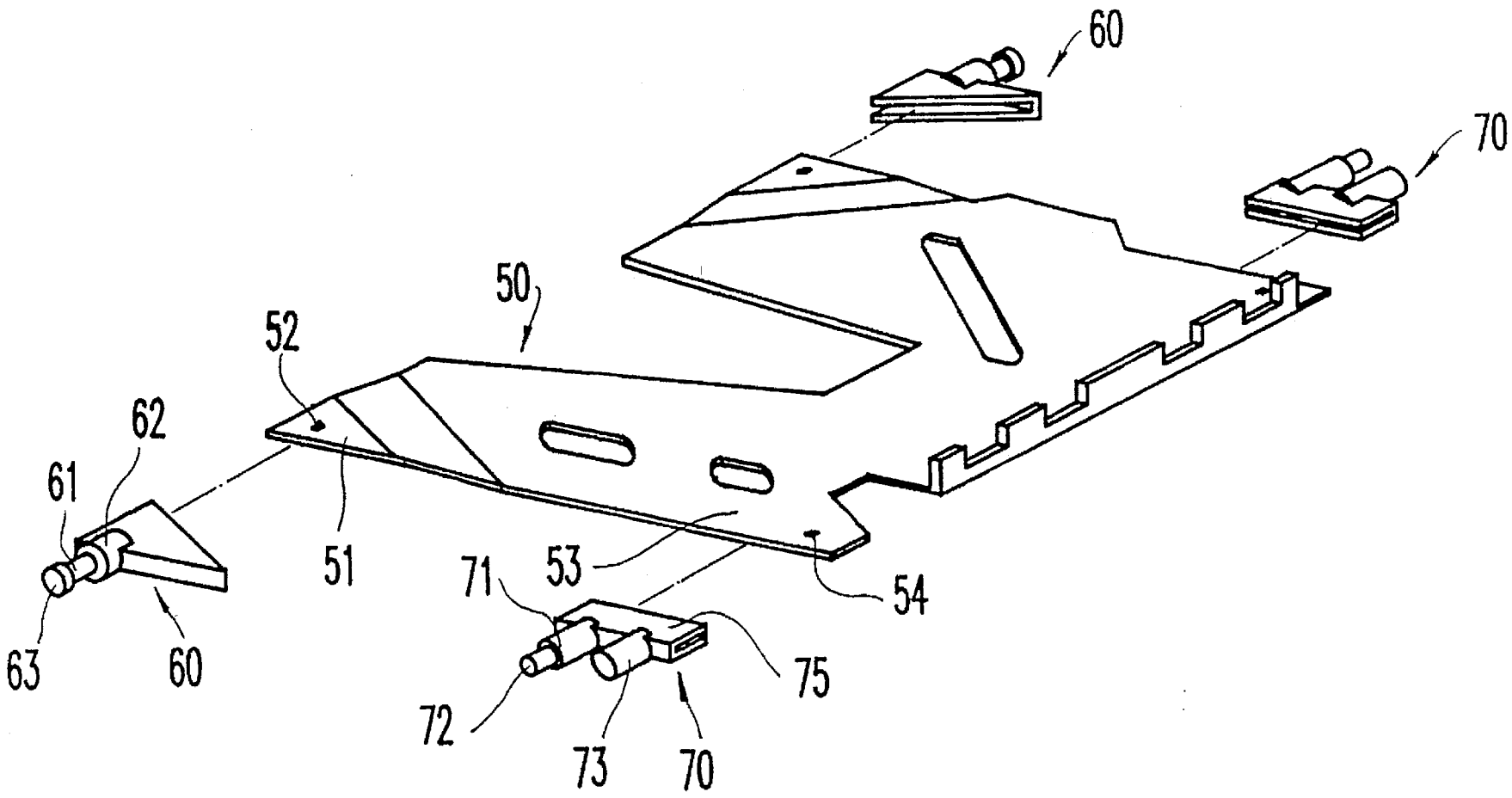
FIG. 4A is a exploded perspective view of an assembly type tray according to the present invention.

Referring to FIG. 4A, an assembly type tray 50 comprises a tray member 50 having guide pin connection parts 51 and trunnion connection parts 53 which have a through hole 52 and 54 respectively, and separate guide pin portions 60 and trunnion portions 70 which are latched in the through holes 52 and 54.

Figure 4B:
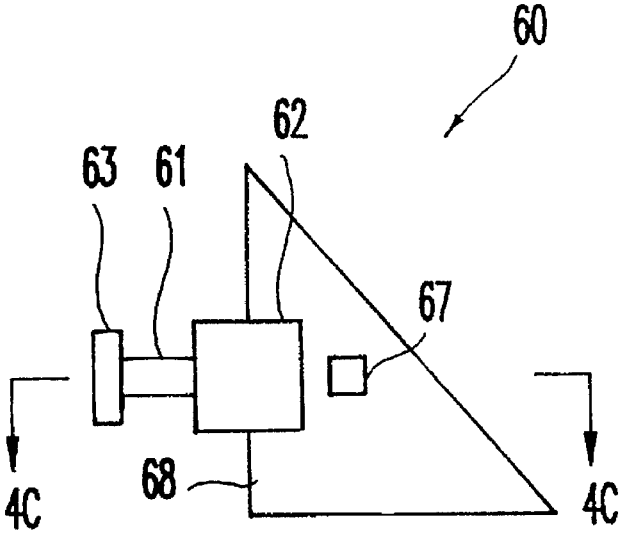
FIG. 4B is a bottom view of a guide pin portion.
Figure 4C:
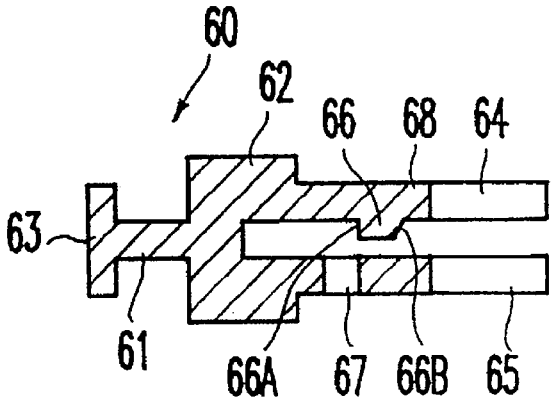
FIG. 4C is a cross-sectional view of a guide pin portion as viewed on 4C—4C line of FIG. 4B.
Figure 4D:
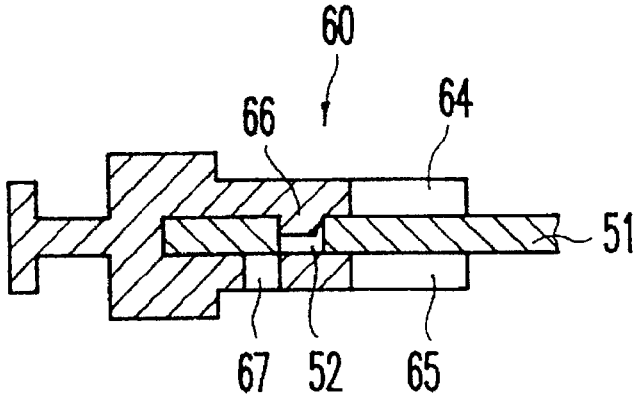
FIG. 4D is a cross-sectional view similar to FIG. 4C showing the assembled situation of the guide pin portion and the guide pin connection part of a tray.

FIGS. 4B to 4D are a rear view and a cross-sectional view taken along line A—A of a guide pin portion 60 which is latchingly connected to a guide pin connection part 51 of the tray member 50, and a cross-sectional view of the assembled guide pin portion 60 and the guide pin connection part 50, respectively. The guide pin portion 60 comprises a latch connection section 68 and a guide pin section 61, wherein the latch connection section 68 of guide pin portion 60 is shaped triangular, since the guide pin connection part 51 is shaped triangular according to the shape of frontal edges of the tray member 50 as shown in FIG. 4A, and a guide pin 61 has a boss 62 and a circular enlarged portion 63 as mentioned above.

The latching connection section 68 consists of a couple of diverged resilient members 64 and 65 which can be bent outwardly and resiliently as shown in FIG. 4C. The first resilient member 64 has a latching protrusion 66 having a vertical surface 66A and an inclined surface 66B to engage the through hole 52 of the guide pin connection part 51 of the tray member 50, so that when the guide pin connection part 51 is inserted between the resilient members 64 and 65, the first member 64 is bent upwardly with the inclined surface 66B engaging the edge of the part 51 and returns to the initial condition latchingly inserted into the through hole 52 of the part 51. The latching protrusion 66 is securely fixed in the hole 52, since the vertical surface 66A engages the wall of the hole 52. Referring to FIGS. 4B and 4C, the through hole 67 of the second resilient member 65 is for insertion of a core in molding the latching protrusion 68 of the first resilient member 64. Therefore the through hole 67 needs to be formed in accord with the vertical surface 66A of the latching protrusion 68, as shown in FIG. 4C.

Figure 4E:
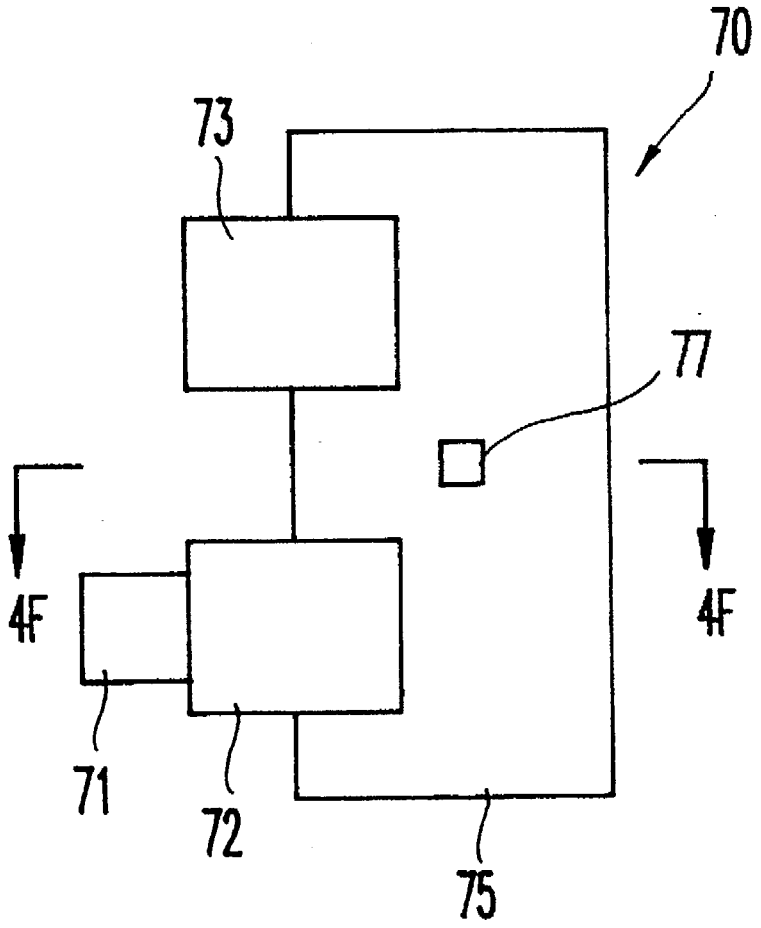
FIG. 4E is a bottom view of a trunnion portion.
Figure 4F:
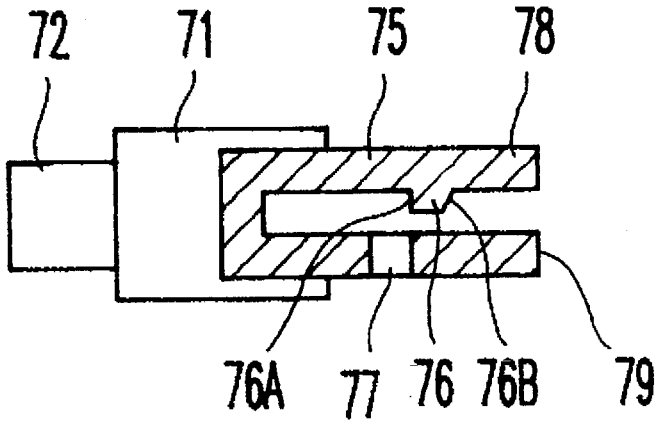
FIG. 4F is a cross-sectional view of the trunnion portion taken along line 4F—4F of FIG. 4E.

FIGS. 4E and 4F are a rear view and a cross-sectional view taken along the line B—B of trunnion part 70, respectively. The structure of the trunnion portion 70 is similar to that of the guide pin portion 60 except that a couple of trunnions 72 and 73 are molded at the trunnion section and a latching connection section 75 has the square shaped resilient members 78 and 79. The latching connection section 75 of the trunnion portion 70 is also widened resiliently and has a latching protrusion 76 which latchingly engages the through hole 54 of the trunnion connection part 53 and have a through hole 77 in the second resilient member 79 for molding the latching protrusion 76.

The tray 10 and the assembly type tray 50 described as the above can be used to any other existing sorter of the Tray Shifting Type as well as the sorter according to the invention.

The tray shifting mechanism of the sorter according to the invention will be described.

Referring to FIGS. 1 and 2, the trays 10 are stacked on the tray supporter 80 and the top of the trays is covered by a tray cover 90. In order to guide the trays 10 to the drive wheel assembly 100, a tension spring 126 is installed on the side wall 120 of the sorter with the upper end of the spring 126 fixed on the upper part of the side wall 120 and the lower end fixed on the tray supporter 80. The tension spring 126 is installed in tensile condition and elastically ascends the supporter 80 along the vertical hole 125 of the side wall 120. Accordingly, when the trunnions 30 and 35 of a tray 10 enters in the drive wheel assembly 100, the trunnions 30 and 35 of the next tray 10 contact the drive wheel assembly 100 by the restoring force of the tension spring 126. Ascension of trays 10 is accomplished by the restoring force of the tension spring 126 but the descent of the trays 10 is accomplished by weight of the trays themselves. Further, the trays 10 stacked on the drive wheel assembly 100 are ascended by the tension spring 126 and are descended by pushing power of the drive wheel assembly 100 in the lower side. However, the trays 10 stacked below the drive wheel assembly 100 are ascended sequentially by pushing power of the drive wheel assembly 100 and are descended by their weight themselves in the upper side. Referring to FIG. 2, the tray cover 90 has a pair of restraining means 92 extending toward the trunnions 30 and 35 oppositely. The restraining means 92 prevents the trunnions 30 and 35 stacked at the upper side from being raised above the drive wheel assembly 100 by accident, which may happen in the event that the operator pushes or touches the front end of the tray 10 during the descent operation of the trays 10. The restraining means 92 is the part which is extended from the cover 90 toward the trays 10 in order to push the trunnions 30 and 35 downwardly. Also, a pair of connection members 91 which may be separate members or integral parts of the cover 90 are fixed between the tray cover 90 and the tray supporter 80. Therefore, the trunnions 30 and 35 can smoothly and sequentially enter the drive wheel assembly 100 in the descent operation.

Figure 5A:
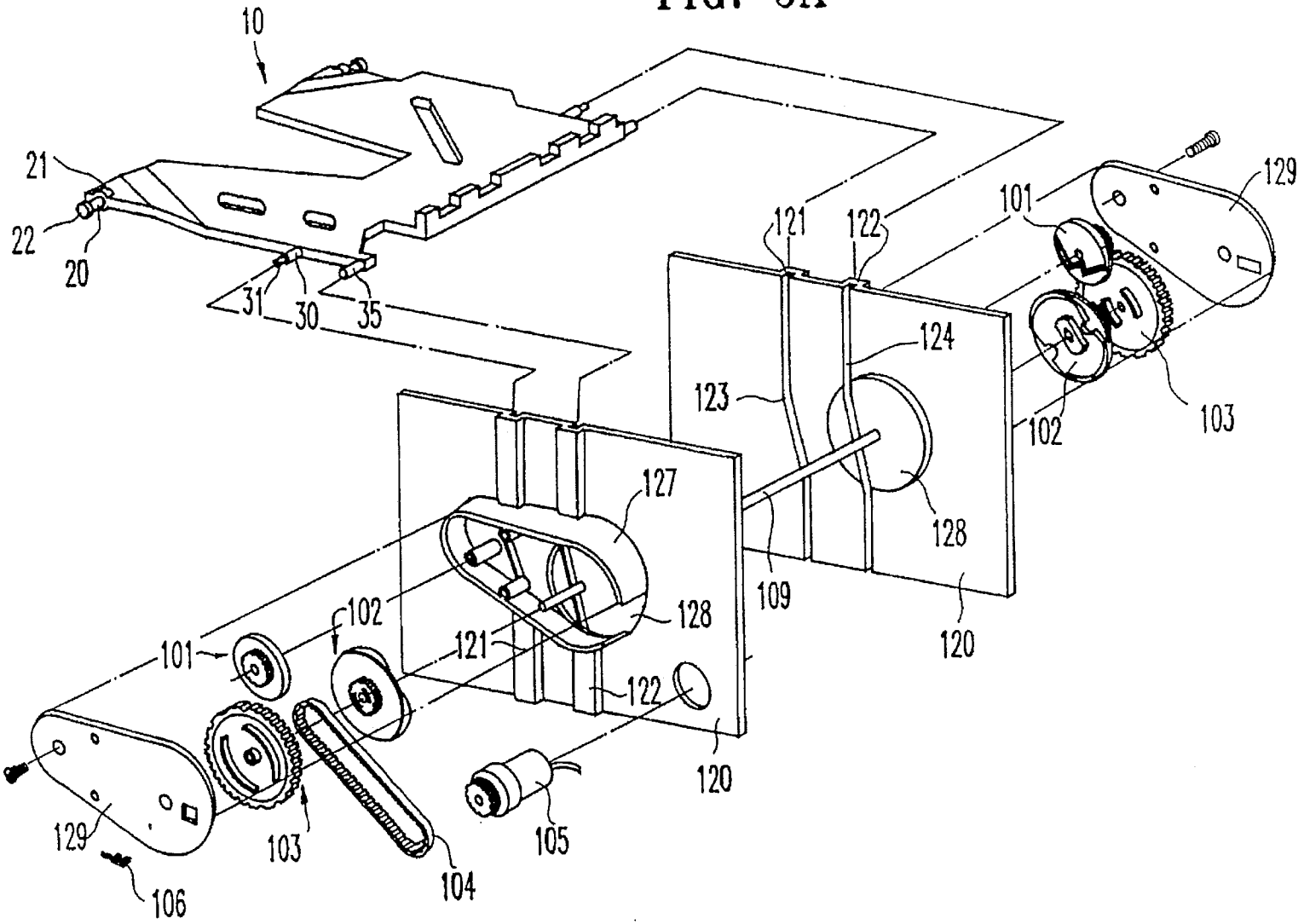
FIG. 5A is an exploded perspective view of the sorter according to the invention.
Figure 5B:
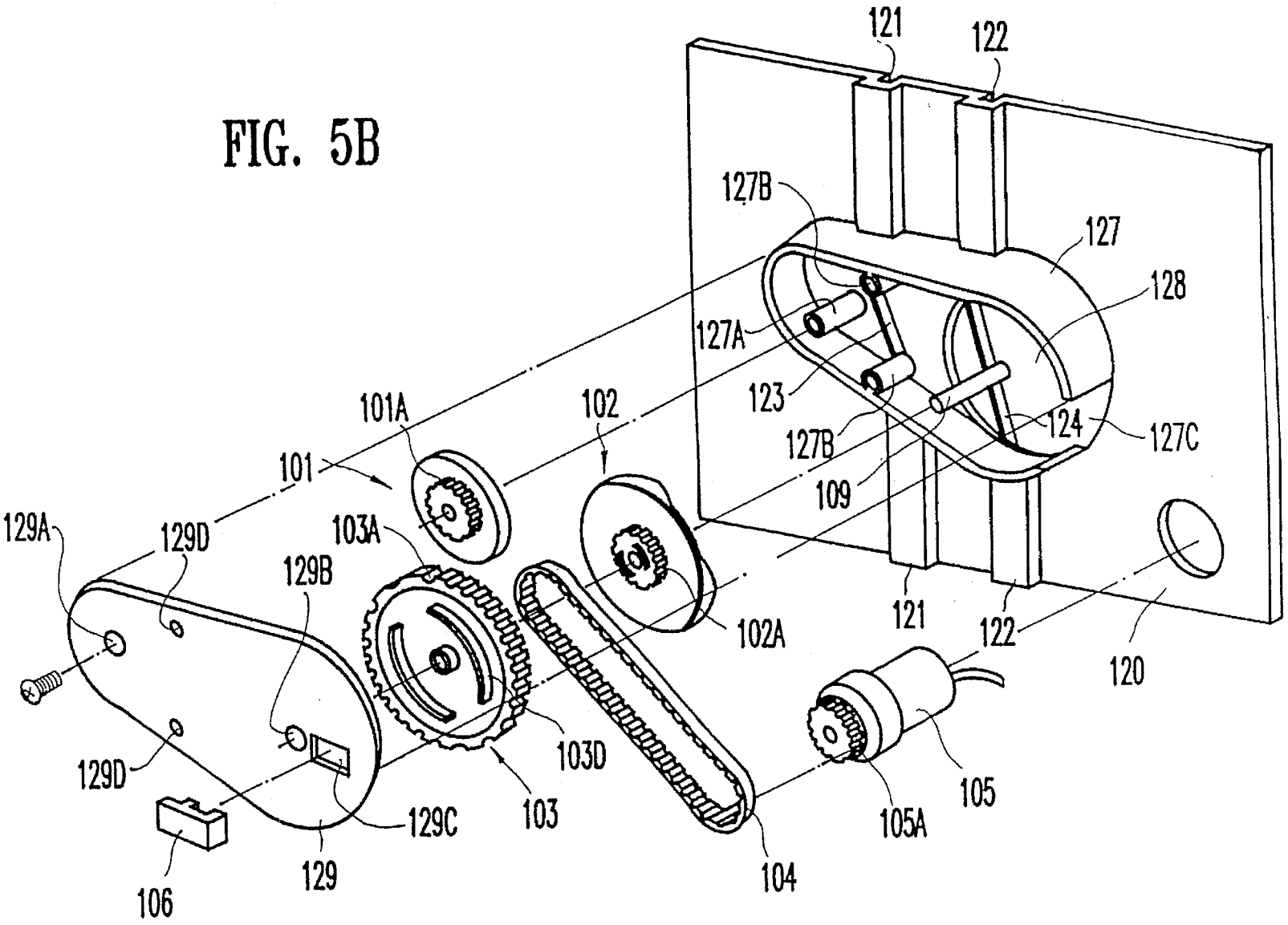
FIG. 5B is an enlarged perspective view of a driving wheel assembly and one side wall of the sorter.

FIGS. 5A and 5B are exploded perspective views of the drive wheel assembly 100 according to the invention.

As shown in FIG. 5A, a couple of vertical slots 121 and 122 are formed in parallel with each other on the side walls 120 of the sorter, and the trunnions 30 and 35 of the trays 10 are received in the vertical slots 121 and 122. The side walls 120 further have a housing 127 in which the drive wheel assembly 100 is installed and the vertical slots 121 and 122 have through holes 123 and 124 through which the trunnions 30 and 35 are coordinated with a cam wheel 101 and a supplementary wheel 102. The trunnions 30 and 35 are inserted and extended in the vertical slots 121 and 122 which are protruded outwardly, and contact with the peripheral wall (101G, FIG. 6A) of the cam wheel 101 and the cam surface (102D, FIG. 6A) of the supplementary wheel 102 on or beneath the housing 127.

A drive wheel assembly 100 may consist of various combination of wheels but essentially includes a cam wheel 101 and a supplementary wheel 102. Therefore, the combination of wheels as shown in FIGS. 5A and 5B is a preferred embodiment of the drive wheel assembly 100 according to the invention, but the invention is not limited to that.

FIG. 6 is a perspective view of the assembled drive wheel assembly 100. As shown in FIG. 6 (for the convenience, it shows a drive wheel assembly of the right side in FIG. 5A), the cam wheel 101 and the supplementary wheel 102 are partially overlapped. The supplementary wheel 102 is installed first in the housing 127 and then the cam wheel 191 is installed to partially overlap the supplementary wheel 102. A gear wheel 103 having a toothed part 103A therearound geared with a toothed part 101A of the cam wheel 101 is attached to the supplementary wheel 102 to complete the assembly 100. As the supplementary wheel 102 should be installed more deeply than the cam wheel 101 to the side wall 120, a circular recess 128 is formed in the housing 127 at the location where the supplementary wheel 102 is mounted as shown in FIG. 5A. The extension end 31 of the first trunnion 30 which is explained referring to FIG. 3, is inserted in the passage slot 101B of the cam wheel 101 which is shown in FIG. 6A. The second trunnion 35 contacts with cam surfaces 102D and 102D' or circular recess 102E, or passes through opening 102E' of the supplementary wheel 102, 102' as shown in FIGS. 6A and 7. Therefore, the first trunnion 30 should be made longer than the second trunnion by the extension end 31.

Referring to FIGS. 1 and 2, the vertical slots 121 and 122 are formed in parallel with each other above and below the drive wheel assembly 100 but are offset in the housing 127. Accordingly, the through holes 123 and 124 are inclined toward the front end of the trays 10. As will be explained referring to FIGS. 8A to 8F below, the extension end 31 of the first trunnion 30 enters through an entry 101E and leaves from an exit 101F of the passage slot of the cam wheel 101 to ascend or descend therethrough according to a clockwise rotation (tray descent) or a counterclockwise rotation (tray ascension) of the cam wheel 101 and at the same time the trunnion 30; therefore the tray 10 is moved forward or backward in pivotal movement. The upper and lower vertical slots 121 and 122, therefore, should be offset a distance slightly less than diameter of the cam wheel 101 and the through holes 123 and 124 should be inclined toward the upper vertical slots 121 and 122. Further, this operation also changes the slope of the trays since the trunnions 30 and 35 are captivated in the slots 121 and 122. Therefore, the front end of the trays are moved forwardly a little further. This is the reason that the guide pin 20 is moved upward in the guide hole 41 when the trays 10 are stacked on the drive wheel assembly 100.

Referring to FIG. 5B, one drive wheel assembly 100 (driving part) comprises a cam wheel 101 and a supplementary wheel 102 and is directly driven by a motor 105 via a timing belt 104 and the other opposite drive wheel assembly 100 (driven part) is driven by operation of the one drive wheel assembly 100 via a horizontal shaft 109 connecting the supplementary wheels 102 of both assemblies. The cam wheels 101 of both drive wheel assemblies 100 are connected to and rotated by the supplementary wheel 102 via the separate gear wheel 103 attached to the supplementary wheel 102. For this connection, a pair of recesses are formed at the surface of the gear part 102A of the supplementary wheel 102, and matable protrusions are formed in the gear wheel 103, or to the contrary, so that they are mated with each other by inserting the protrusions into the recesses.

The drive wheel assembly 100 is assembled by first installing the supplementary wheels 102 having a central hole 102C in which the horizontal shaft 109 is inserted therethrough via holes of the side walls near the second through hole 124 of the vertical slot 122. Then the cam wheel 101 is installed rotationally with the center hole 101C inserted into the hollow cam wheel shaft 127A which is extended outwardly near the first through hole 123. Therefore, the central hole 101C of the cam wheel 101 should be somewhat bigger than the cam wheel shaft 127A.

The toothed part 102A of the supplementary wheel 102 is connected with the toothed part 105A of a motor 105 by a timing belt 104 in the drive wheel assembly 100 of the driving side (left of FIG. 5A). The drive wheel assembly 100 in the driven side is operated by the horizontal shaft 109 connecting therebetween, so that the assembly includes no timing belt 104 and motor 105. Therefore, an opening 127C of the housing 127 which the timing belt 104 pass through, is not provided in the housing (not shown) of the driven side.

Therefore, in the driving side, the gear wheel 103 is assembled to the supplementary wheel 102 after connecting the timing belt 104, however, in the driven side, the gear wheel 103 is assembled without installation of the timing belt.

The arc protrusions 103D of the gear wheel 103 illustrated in FIG. 5B is for an encoder 106 to sense the number of revolutions of the drive wheel assembly 100. As shown in FIGS. 5A to 8, the cam wheel 101 is designed to revolve two times while the supplementary wheel is revolving one time, so that two arc protrusions 103D are provided and the encoder 106 senses the number of revolutions of the cam wheel 101 by sensing the openings between the arc protrusions 103.

After installing the gear wheel 103, attaching a housing cover 129 to the housing 127, for example by using a screw, completes the assembly. In the illustrated embodiment, the screws are threaded into the screw holes 129D of the cover and the screw holes 127B of the housing 127. Also the hollow cam wheel shaft 127A and a screw hole 129A of the cover may be screwed. However, the horizontal shaft 109 is inserted in a through hole 129B of the cover 129 freely and rotationally.

However, the combination and driving method of the drive wheel assembly according to the invention is not limited to the above. Instead of the supplementary wheel 102, the cam wheel 101 may be driven by a motor 105 and the horizontal shaft 109 may connect the cam wheels 101. The gear wheel 103 may be molded in the supplementary wheel 102 or the cam wheel 101 as an integral part thereof. Also two or more gear wheels may be used instead of one gear wheel for connecting the cam wheel 101 and the supplementary wheel 102. Further, instead of gear wheel 103, other conventional power transmission means also may be adopted in order to cooperate the cam wheel 101 with the supplementary wheel 102.

Therefore the engineers in the technical field regarding the invention can construct various types of drive wheel assemblies 100 based on a couple of disk wheels including a cam wheel 101 and a supplementary wheel 102 without departing from the scope of the invention.

Tray Shifting method adopted in the invention is basically to shift the trunnions 30 and 35 by the cooperation of a cam wheel 101 and a supplementary wheel 102. Now the shifting mechanism is described referring to FIGS. 6A and 8A to 8F.

Figure 6A:
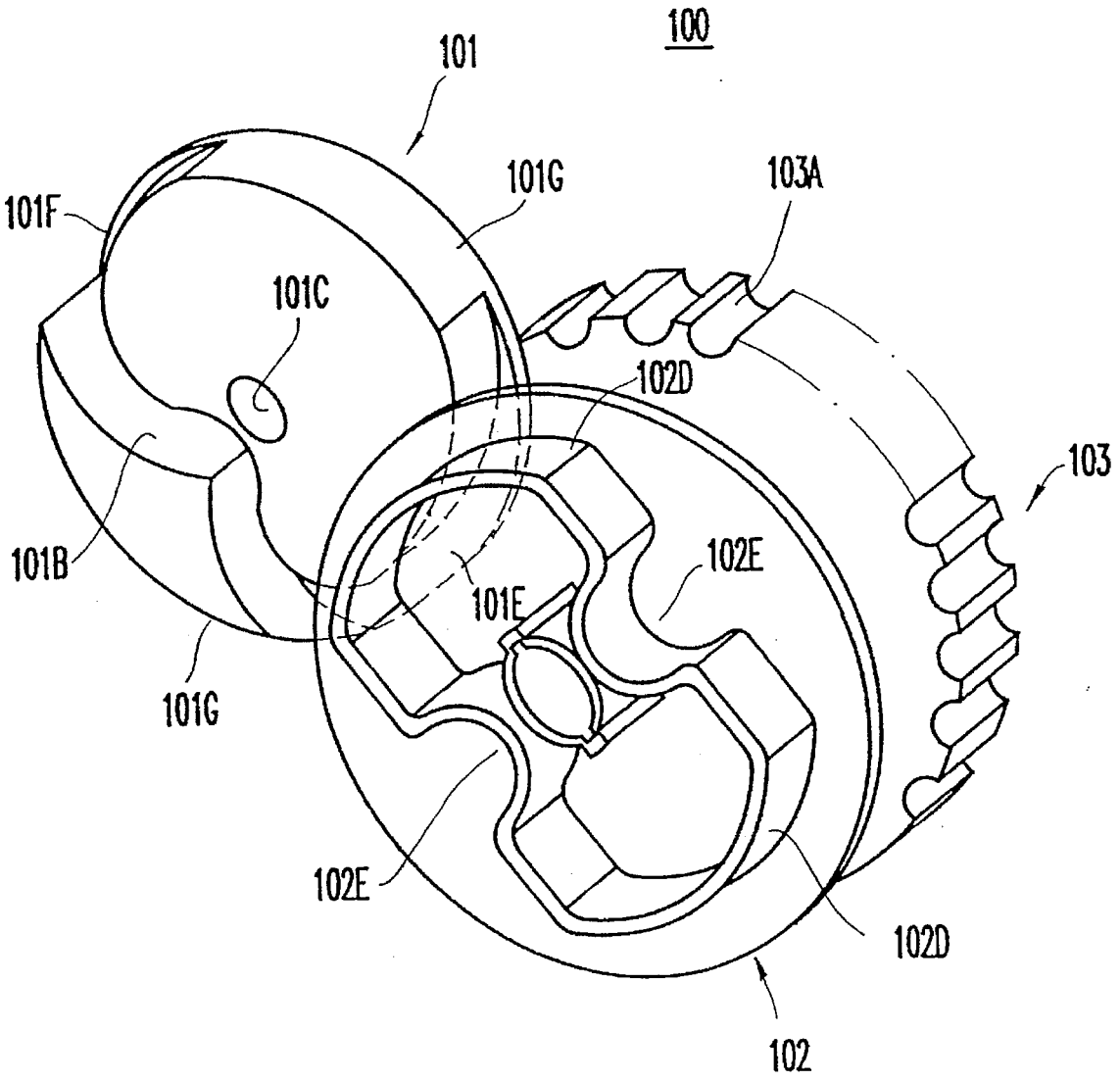
FIG. 6A is an assembled perspective view of the drive wheel assembly according to the invention.
Figure 6B:
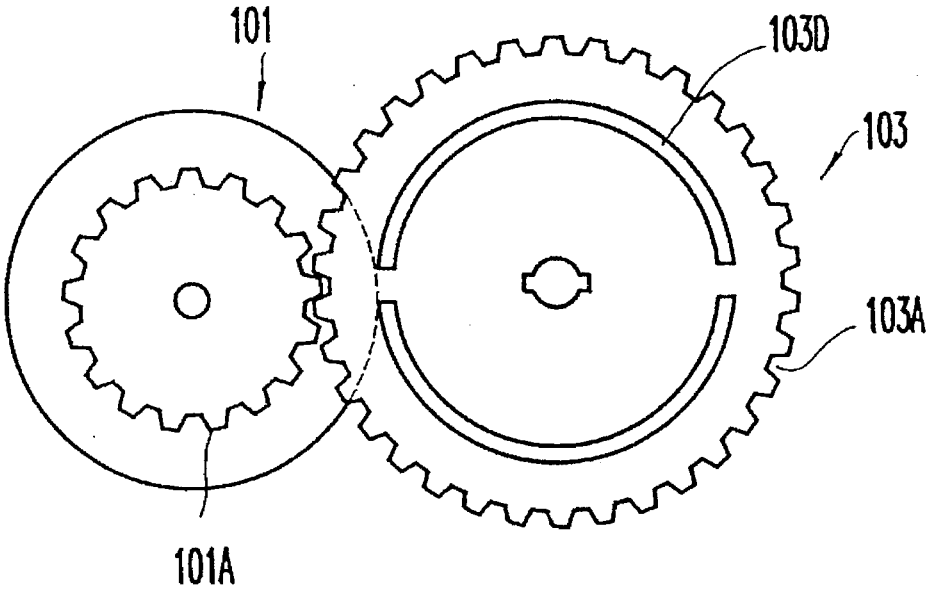
FIG. 6B is a front elevational view showing an engaged situation of a cam wheel and a gear wheel according to the invention.
Figure 6C:
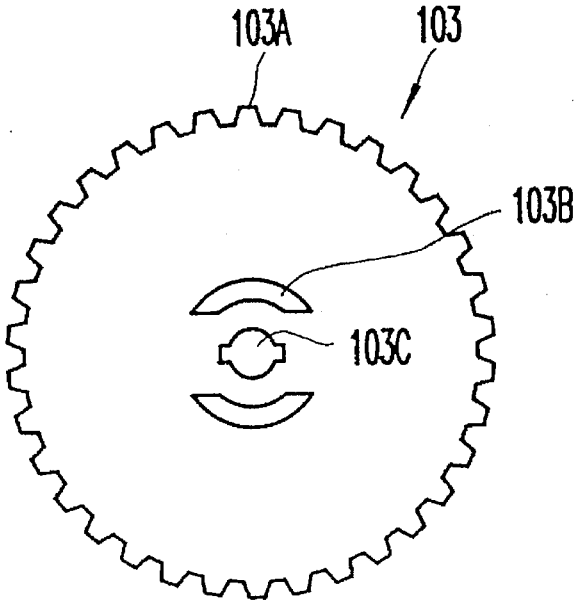
FIG. 6C is a rear view of a supplementary wheel.
Figure 6D:
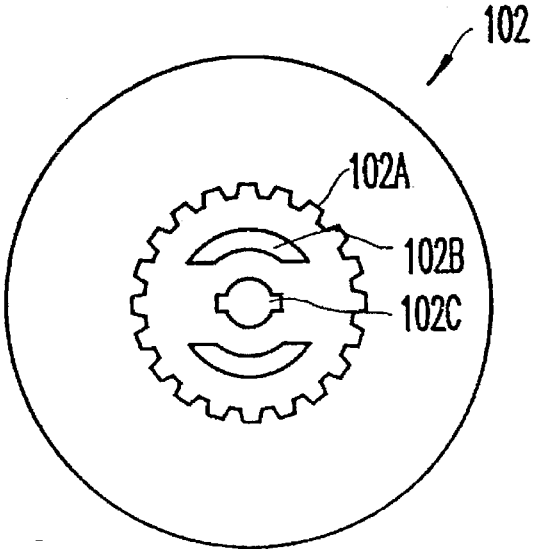
FIG. 6D is a rear view of a gear wheel.
Figure 7:
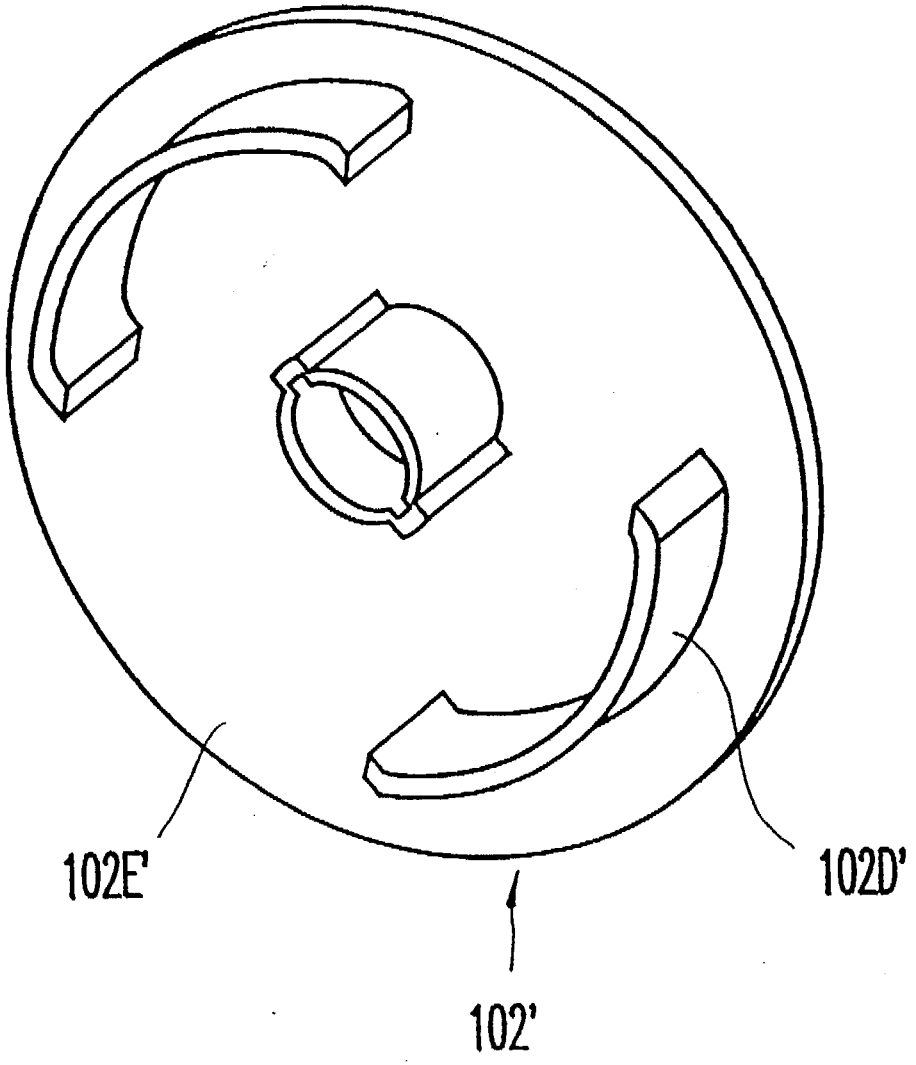
FIG. 7 is a perspective view of a supplementary wheel according to another embodiment of the invention.

As shown in FIG. 6A, a W-shaped slot 101B is formed across the cam wheel 101 and a slow curved entry 101B and an exit 101F are opened at both ends of the slots 101B which the extension end 31 of the first trunnion 30 passes through. The cam wheel 101 rotates to admit the extension end 31 of the first trunnion 30 in the entry 101E at the lower side of the drive wheel assembly and forces the end 31 pass through the W-shape slot 101B. Then the cam wheel 101 discharges the end 31 through the exit 101F at the upper side of the driving wheel assembly 100.

The slot 101B does not need to be W-shaped as illustrated but may be formed in various shapes in consideration of load balance and linear movement of the trunnion 30. If the load balance for the cam wheel 101 is more important, unlinear movement of the trunnion also may be adopted.

The rear end of the tray 10 is raised by the cam wheel 101 at the outlet of the copying machine to provide wider entry of a copy sheet during the pivotal movement of the tray 10 and then the tray 10 is pushed up on the assembly 100. When the first trunnion 30 is ascended by the cam wheel 101, the front end of the tray 10 is moved forward slightly, so that the tray 10 itself is pivoted in the guide hole 41 of the guide member 40 as described above referring to FIGS. 2 and 5A.

The supplementary wheel 102 has a couple of arc cam surfaces 102D which support the second trunnion 35 and serve to prevent the first trunnion 30 of the tray 10, which has already ascended, from falling into the entry 101E or the exit 101F of the slot 101B. Regarding the operation of the supplementary wheel 101, it will be described referring to FIGS. 8A to 8F.

FIGS. 8A to 8F show the cam wheel 101 and the supplementary wheel 102 during operation according that the cam wheel 101 rotates by 60 degrees sequentially. They illustrate the operational steps of the cam wheel 101 and the supplementary wheel 102 at the driven side along with the vertical slots 121 and 122.

Figure 8A:
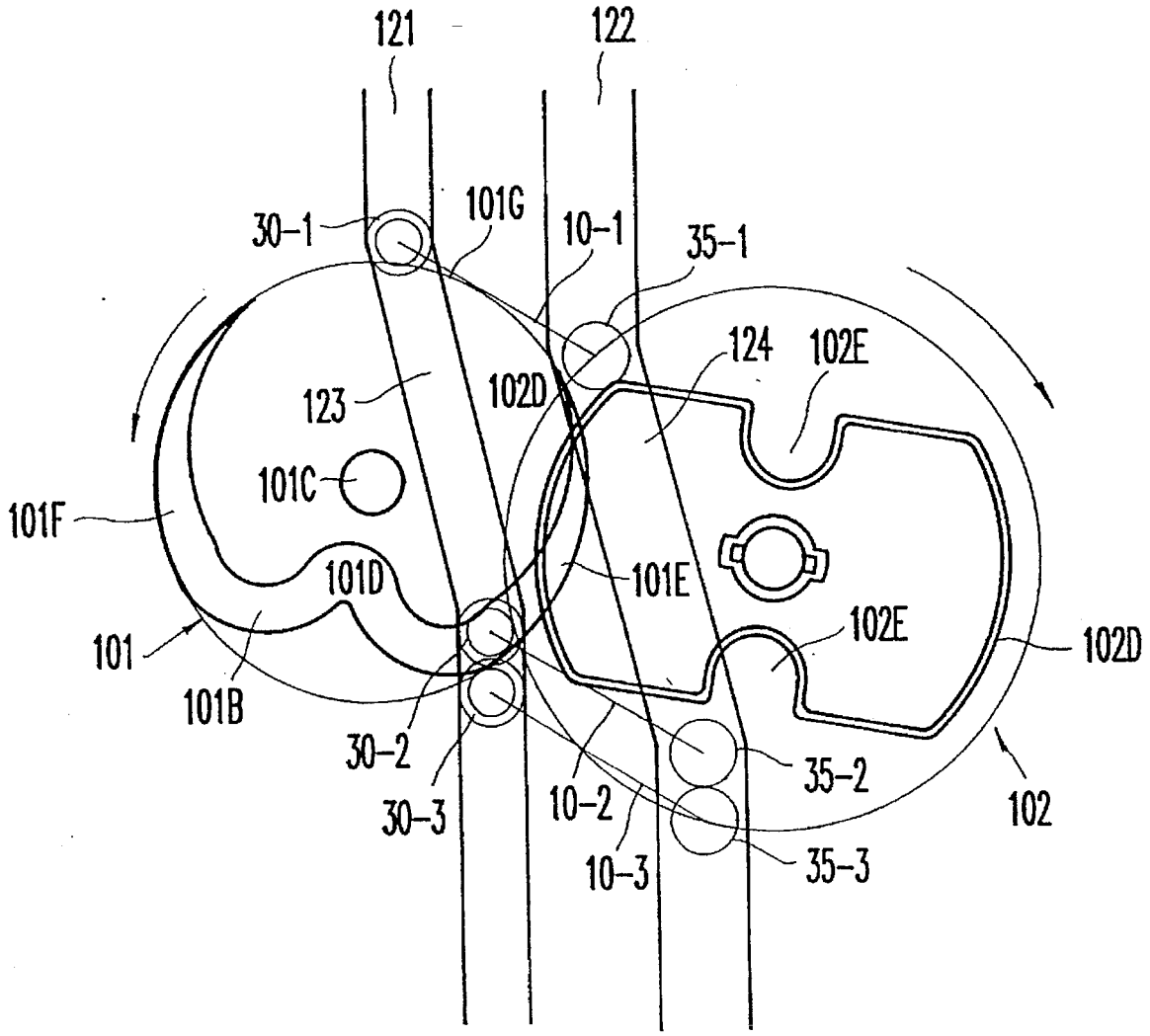
FIGS. 8A to 8F are enlarged views of the drive wheel assembly showing operational sequence of the invention.

FIG. 8A shows a step where the first tray 10-1 has ascended and the trunnions 30-2 and 35-2 of the second tray 10-2 start to ascend. The first trunnion 30-2 of the second tray 10-2 which had contacted the lower end of the cam wheel 101 enters the entry 101-E of the cam wheel 101 by the spring (not shown) while the second trunnion 35-2 ascends to the recess 102E between a couple of the opposite cam surfaces 1020 of the supplementary wheel 102.

Figure 8B:
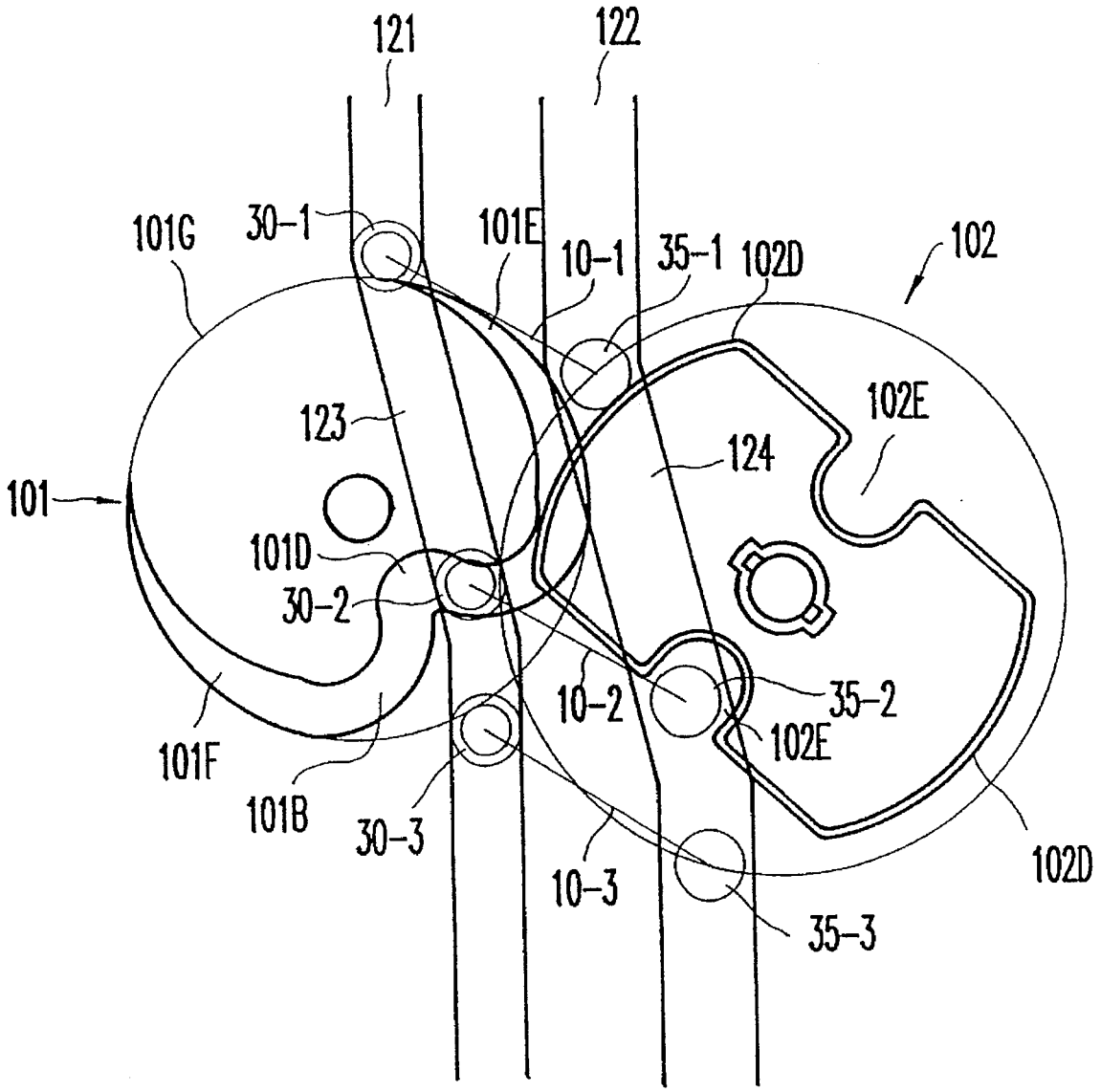

FIG. 8B shows a step in which the cam wheel 101 has rotated by 60 degrees. The first trunnion 30-2 of the second tray 10-2 ascends along the first through hole 123 of the side wall 120. At this stage, the entry 101E of the slot 101B of the cam wheel 101 comes close to the first trunnion 30-1 of the first tray 10-1 which already has ascended. However, the cam surface 102D of the supplementary wheel 102 rotates to support the second trunnion 35-1 of the first tray 10-1 to prevent the first trunnion 30-1 from falling into the entry 101E. At the same time, the second trunnion 35-2 of the second tray 10-2 comes into the recess 102E of the supplementary wheel 102.

Figure 8C:
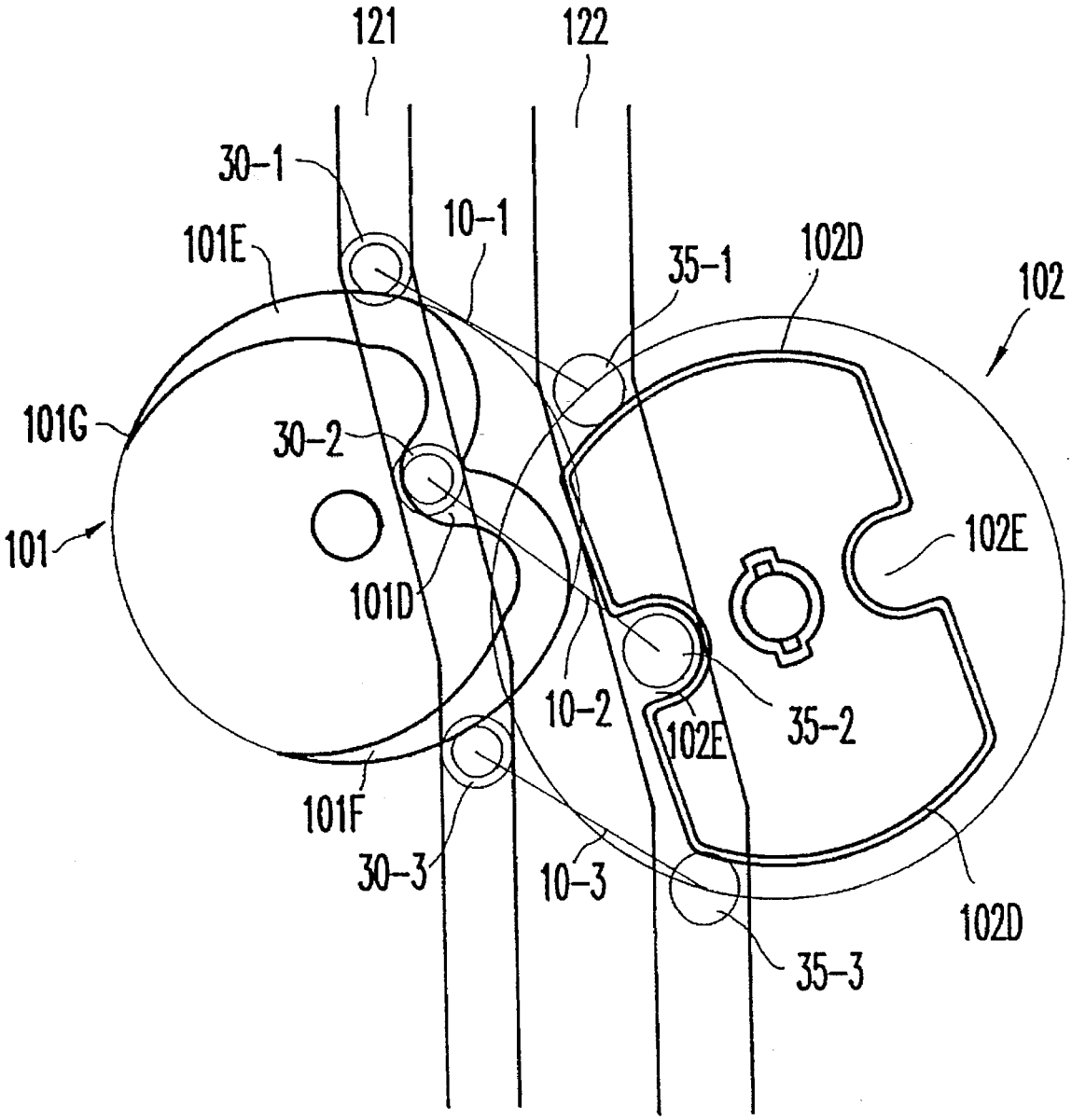

FIG. 8C shows a step where the cam wheel 101 has rotated by another 60 degrees and the first trunnion 30-2 passes through a reversely curved part 101D of the slot 101B. The cam surface 102D of the supplementary wheel 102 supports the second trunnion 35-1 of the first tray 10-1 since the first trunnion 30-1 still may fall into the entry 101E of the slot 101B, so the first trunnion 30-1 is floating over the cam wheel 101.

Figure 8D:
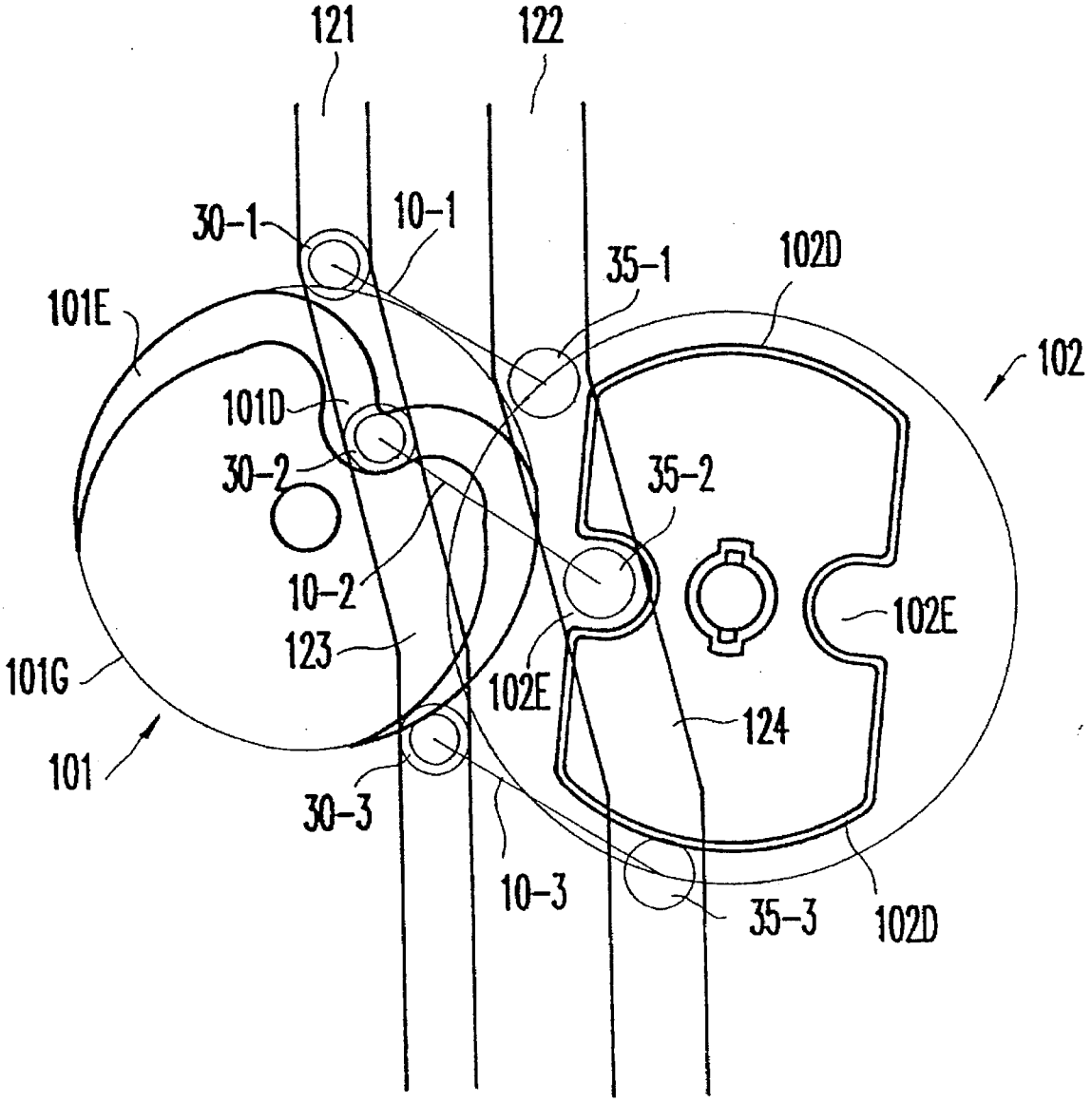
Figure 8E:
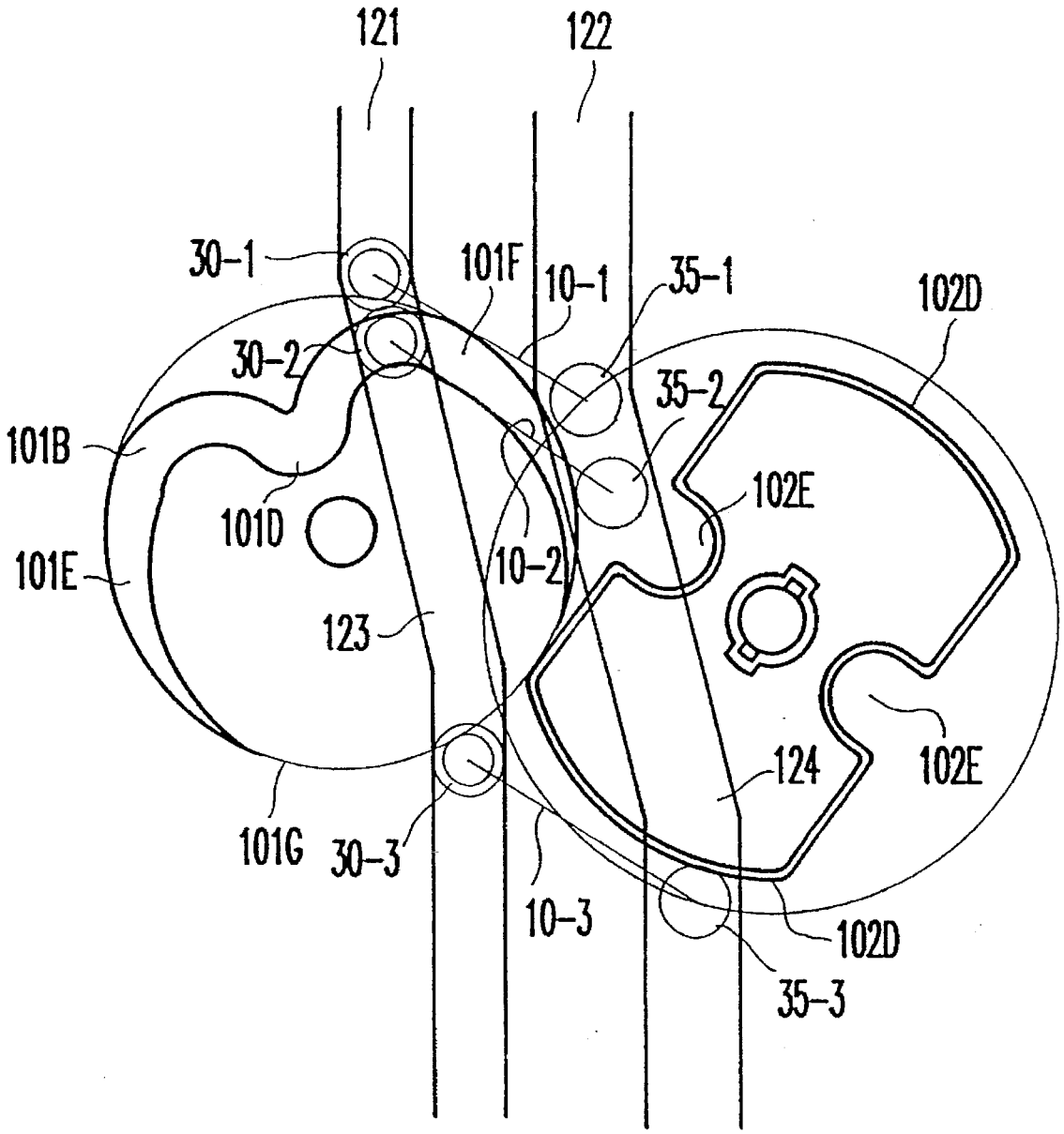
Figure 8F:
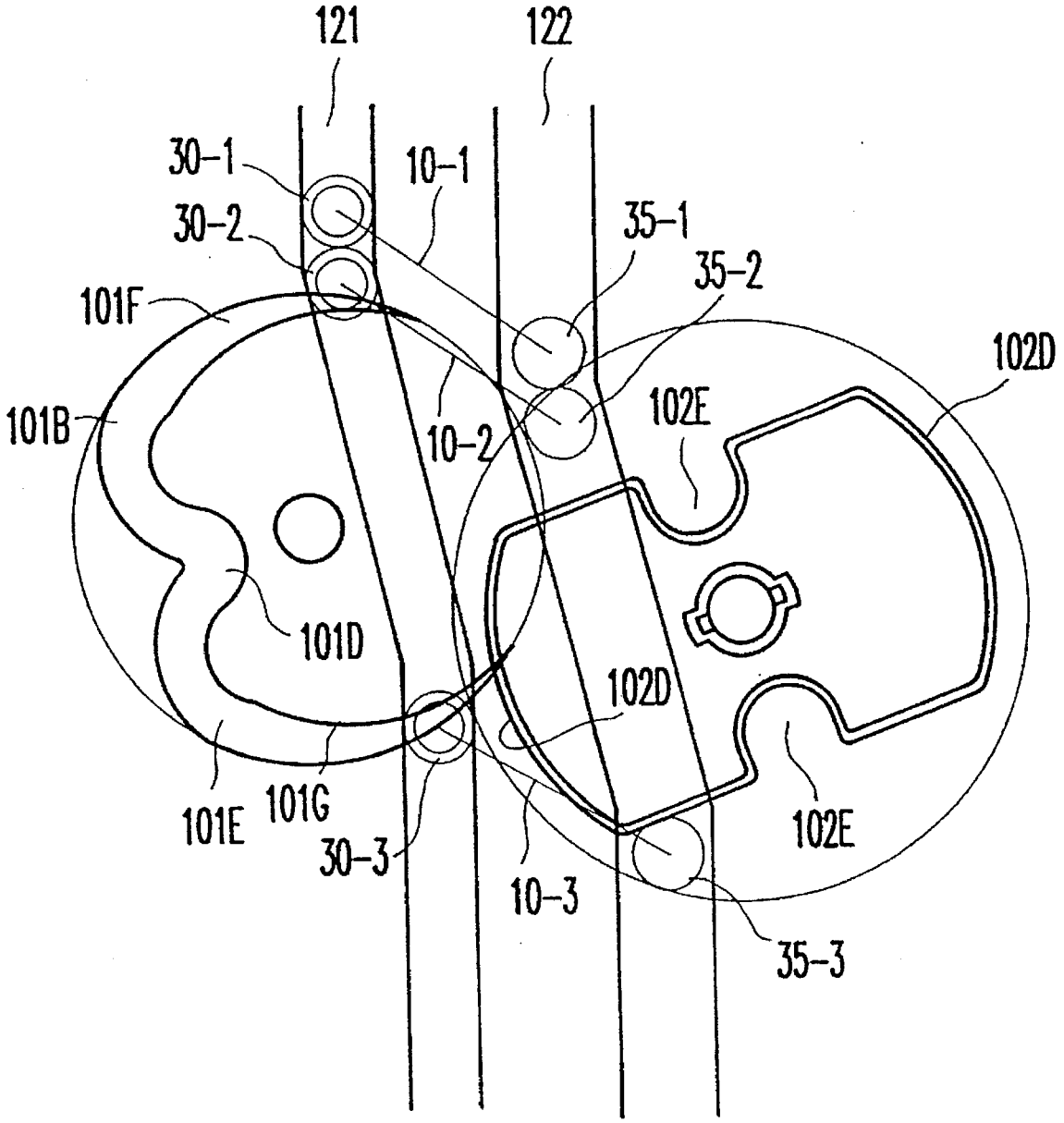

FIGS. 8D to 8F show the following ascension steps that the first trunnion 30-2 and the second trunnion 35-2 of the second tray 10-2 ascend along the through holes 123 and 124 of the side wall 120 while the cam wheel 101 rotates further 180 degrees. The first trunnion 30-2 is continuously ascended according to the shape of slot 101B during the rotation of the cam wheel 101. The first trunnion 30-1 of the first tray 10-1 is supported by the circumferential wall 101G of the cam wheel 101 during the steps since the entry 101E have passed. The cam surface 102D of the supplementary wheel 102 which prevented the first trunnion 30-1 from falling into the entry 101E of the slot 101 is finished and the second trunnion 35-2 comes out of the recess 102E and ascends over the supplementary wheel 102. Accordingly, FIGS. 8E and 8F shows that the second trunnion 35-2 is floating while the tray 10-2 is supported by the circumferential wall 101G of the cam wheel 101. FIG. 8F shows a step where the cam wheel 101 has rotated by 300 degrees and the supplementary wheel 102 has rotated by 150 degrees from the step of FIG. 8A. When the first trunnion 30-2 is discharged from the exit 101F of the cam wheel 101, the ascension of the second tray 10-2 is completed and the first trunnion 30-3 of the third tray 10-3 contacts the cam wheel 101 by the tension spring 126. When the cam wheel 101 rotates further 60 degrees, it returns to FIG. 8A and the ascension of third tray 10-3 will be accomplished by repeating the same steps as described above.

A supplementary wheel 102' according to the second embodiment has a couple of arc cam surfaces 102D' only in the opposite directions, and the openings 102E' in place of the recesses 102E between the cam surfaces 102D' are the gate for the second trunnion 35 where the second trunnions 35 of trays are admitted and pass through the wheel 102' according to the rotation of the cam wheel 101. The second trunnion 35 will be discharged from the gate 102E' when the ascension is completed and supported on the cam surfaces 102D' in order to prevent the first trunnions 30, which have already ascended on the drive wheel assembly 100, from falling into entry 101E of slot 101B of cam wheel 101 during the following operations. The explanation of the operational steps of the second embodiment is omitted since they are substantially the same as those of the first embodiment as described above. The second embodiment of the supplementary wheel 102' features having gates 102E' instead of the recesses 102E of the supplementary wheel 102 according to the first embodiment.

As explained in the above, the rear ends of trays 10-1, 10-2, 10-3 are pivoted sequentially at the outlet to allow easy discharge of the copy sheets while the first trunnions 30-1, 30-2, 30-3 are admitted into the entry 101E, pass through the slot 101B and come out of the exit 101F by the shape of the slot 101B of the rotating cam wheel 101. During the operation, the cam surfaces 102D of the supplementary wheel 102 prevent the ascended first trunnions 30-1 from being dropped into the entry 101E of the slot 101B. Therefore, the invention provides a simple and compact disk cam type sorter in which there is no conflict noise such as occurs in the existing disk cam type sorter. Also the invention provides a sorter which can shift trays with minimum power since loads on the wheels are almost uniform through out the operation.

When the desired trays are ascended according to the number of copy sheets, the drive motor is inverted and the cam wheel 101 and the supplementary wheel 102 are operated in the reverse direction so that the trays return to their original positions the drive wheel assembly 100. These operations of ascension and reversed descent are repeated according to the number of the document pages in order to provide a desired number of copy sets of the document. When the copying operation is completed, the user can draw out the collated sets of copy sheets at a V-shaped opening in the front center of trays 10 as shown in FIGS. 3 and 5A.

Figure 9:
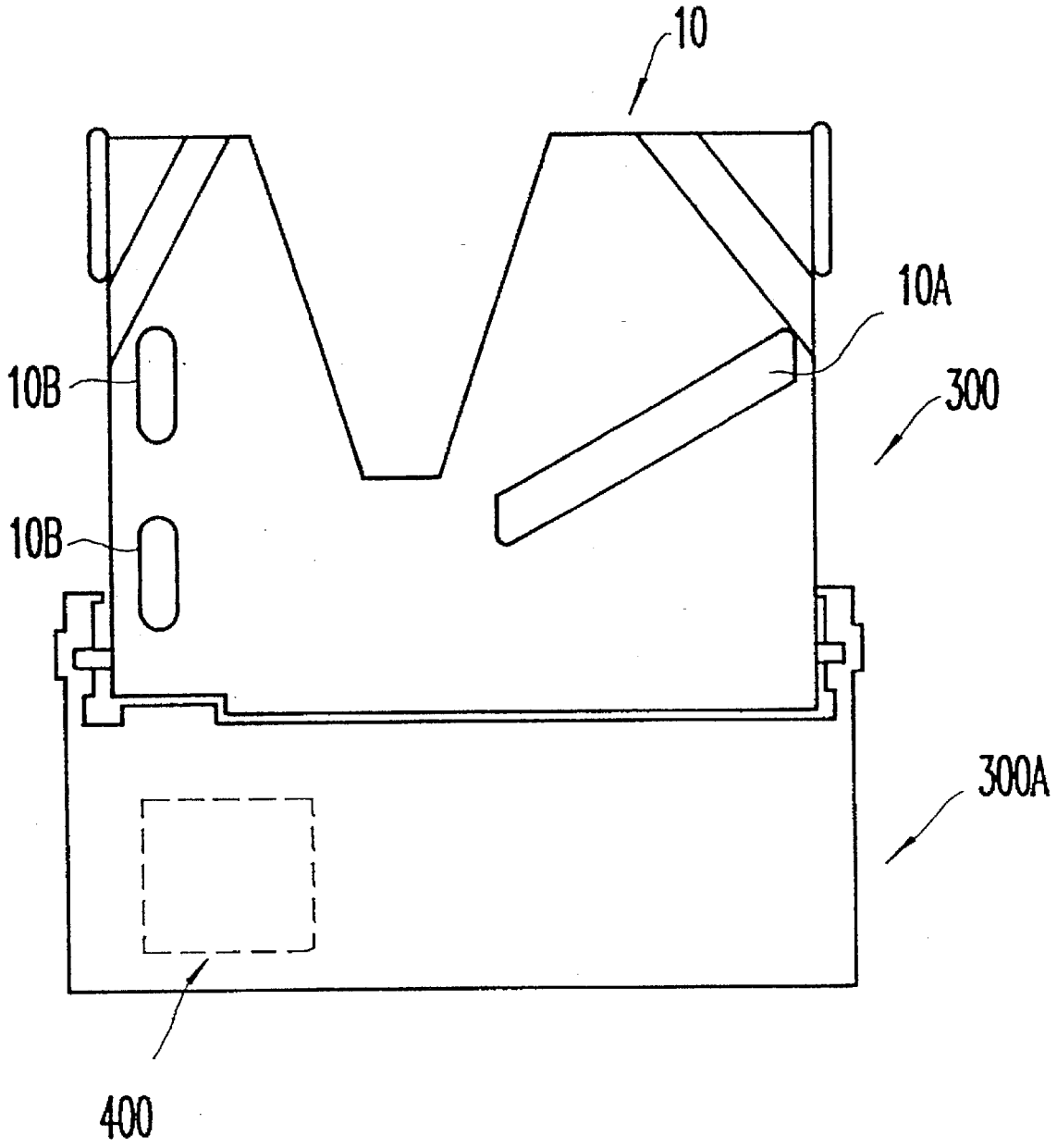
FIG. 9 is a plane view showing the relationship of a tray, a sheet jogging device and a stapling device according to the invention.

FIG. 9 is the plane view of a sorter showing the locations of trays 10, a sheet jogging device 300 and a stapling device 400 respectively and the relationship therebetween in the sorter. A sheet jogging device of the invention is located under the trays 10 in the outlet part 300A. The outlet part 300A comprises a sorter including sheet discharging rollers and the sheet jogging device 300 is located on a base plate of the outlet part 300A.

Figure 10:
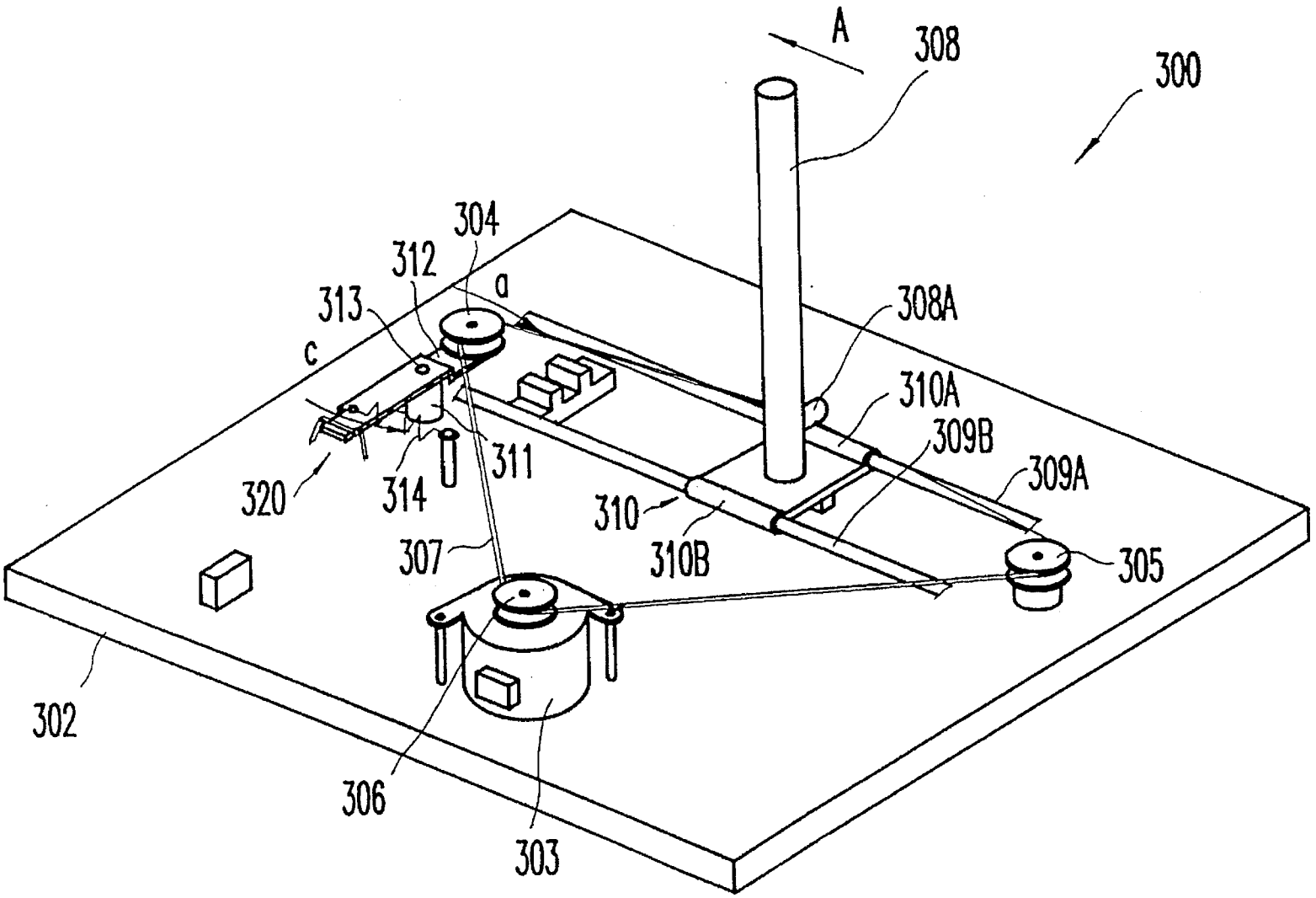
FIG. 10 is a perspective view of a sheet jogging device according to the invention.

FIG. 10 is a perspective view which shows a structure of the sheet jogging device according to the present invention. The sheet jogging device 300 comprises a drive means 303, a driving pulley 306 fixed around a driving shaft of the drive means 303, a first driven pulley 304 rotationally mounted on a pivotable bracket 312, a second driven pulley 305 rotationally mounted on a base plate 302, a wire 307 for power transmission which connects the driving pulley 306 and the first and the second driven pulleys 304 and 305 therearound, an alignment rod 308 and guide rails 309A and 309B. The driving pulley 306 fixed to the shaft of the drive means 303 and the first and the second driven pulleys 304 and 305 rotationally mounted on the support plate 302 are simultaneously operated by the wire 307. The guide rails 309A and 309B are mounted on the support plate 302 in parallel with each other and the alignment rod 308 is located upwardly and vertically between the guide rails 309A and 309B with a pair of bushings 310A, 310B formed oppositely at both ends of the base 310 which receive the guide rails 309A and 309B therein, respectively. The alignment rod 308 has a wire fixing member 308A extended in parallel with the support plate 302 from the lower end, in which the wire 307 is securely fixed, therefore, the alignment rod 308 can be moved along the guide rails 309A and 309B by the wire 307. The wire 307 is supported by the first and second driven pulleys 304 and 305 and is driven by the drive means 303.

Further, a wire tension change means 320 is provided in order to change tension of the wire 307 by changing the location of the first driven pulley 304. The wire tension change means 320 comprises a support member 311 fixed on the support plate 302, a bracket 312 rotationally pivoted on the support member 311 and a spring 314 fixed to the bracket 312 and the support plate 302.

The first driven pulley 304 is mounted on an end of the bracket 312, the spring 314 is fixed to the other end of the bracket 312 with one end. The other end of the spring 314 is fixed on the support plate 302.

Figure 11A:
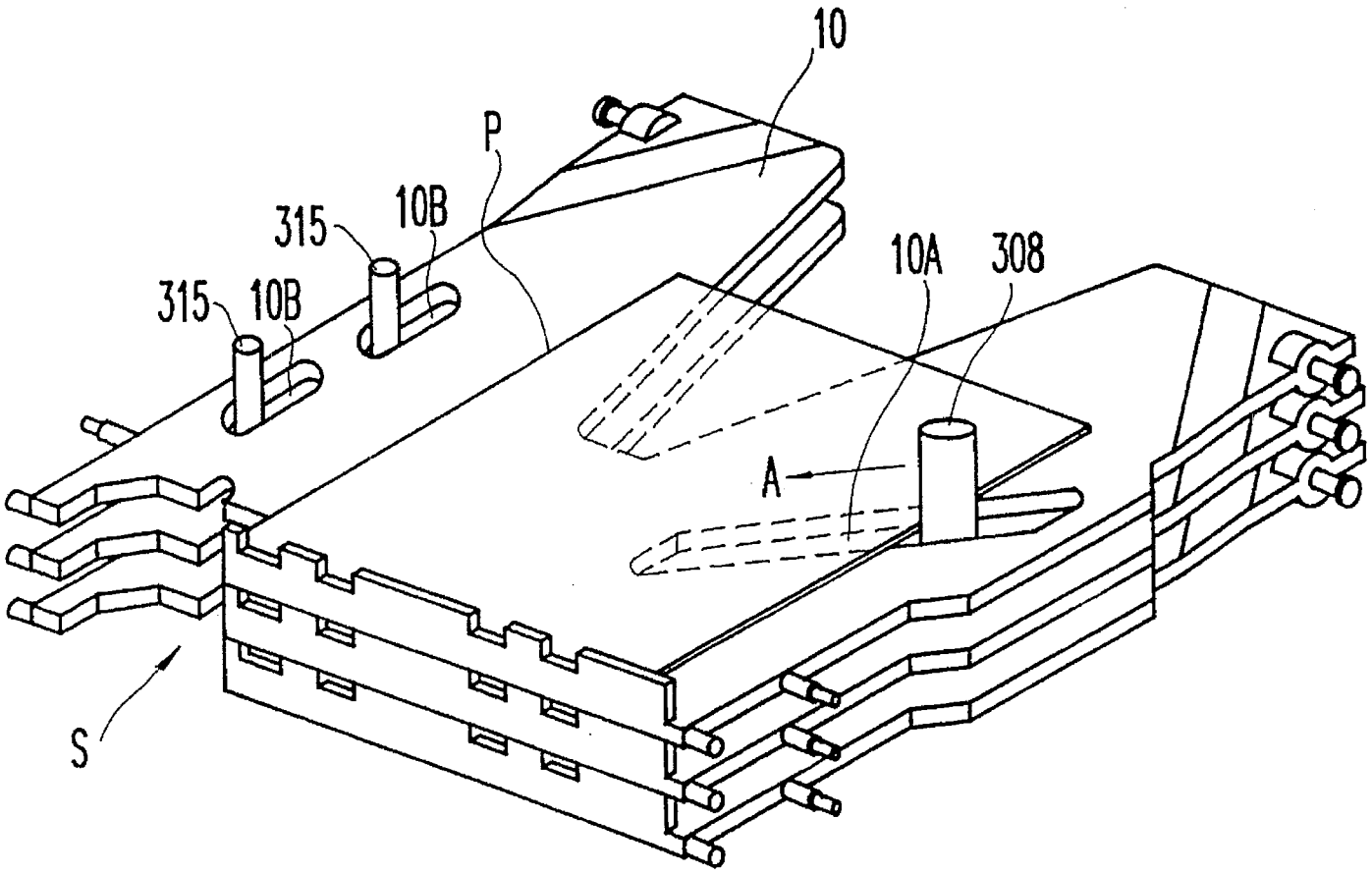
FIG. 11A is a perspective view showing the jogging device prior to operation of a alignment rod.
Figure 11B:
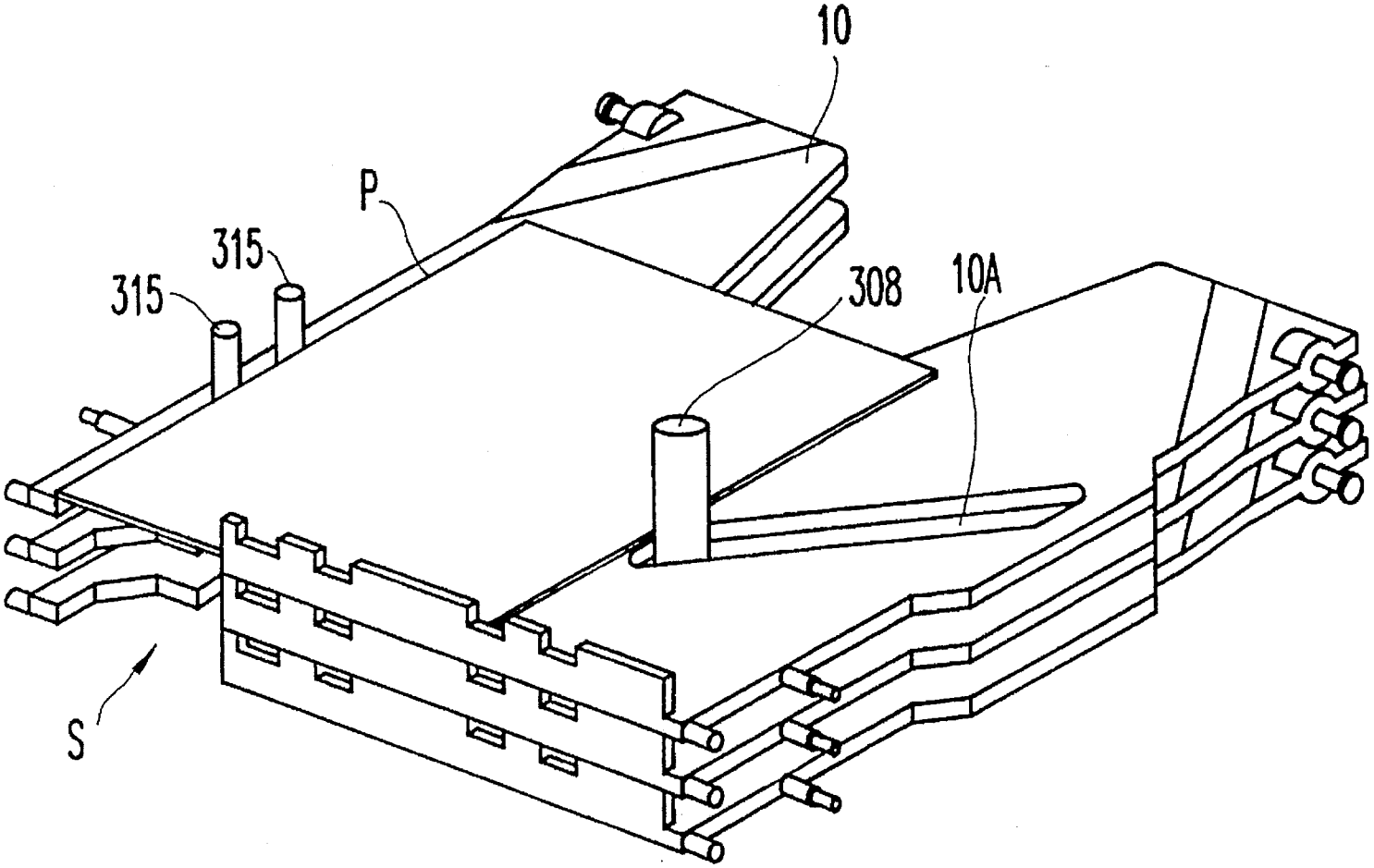
FIG. 11B is a perspective view similar to FIG. 11A showing the jogging device after operation of the alignment rod.

Referring to FIGS. 10, 11A and 11B, the operation of the sheet jogging device will be described.

FIGS. 11A and 11B are perspective views of the trays equipped with the alignment rod of the sheet jogging device. FIG. 11A shows the situation prior to the operation of the alignment rod 308 and FIG. 11B shows the situation when the operation of the alignment rod 308 is finished. The alignment rod 308 is shown by a part exposed over the trays in FIG. 11A and FIG. 11B.

A tray 10 has an oblique rectangular hole 10A at a side portion and the alignment rod 308 is extended vertically through the hole 10A and exposed over the uppermost tray of the stacked trays 10. When copy sheets P have been transferred to each tray 10 by discharging rollers (449R in FIG. 15) as shown in FIG. 11A, the sheet jogging device is operated in order to align the copy sheets P for stapling.

Prior to operation of the sheet jogging device, the alignment rod 308 is located outermost in the hole 10A facing a side edge of the collated sheets P distributed on the central portion of the trays 10. When operated, the driving pulley 306 rotates counterclockwise by drive means 303; then the wire 307 in frictional contact with the driving pulley 306 and the first and second driven pulleys 304 and 305 is circulated around the pulleys, so that the alignments rod 308 moves in the "A" direction (FIGS. 10 and 11A) when the pulleys rotate counterclockwise (operational direction). At this time, the alignment rod 308 slides along the guide rails 309A and 309B with the first and second bushings 310A and 310B of the base 310 and moves downwardly in the rectangular holes 10A of the trays 10.

In accordance with the linear movement of the alignment rod 308, the copy sheets P are contacted with the alignment rod 308 and are forced to move to a side end of the trays 10 to be aligned in the stapling position ("S" in FIG. 11B). In order to set the stapling position and assist the jogging operation, it is preferred that at least one support rod 315 is provided and the trays 10 have additional holes 10B through which the support rod 315 is installed so that the copy sheets P are aligned in cooperation with the alignment rod 308 and the support rod 315.

The condition of the wire 307 during movement of the alignment rod 308 will be described referring FIGS. 10 and 12.

Figure 12:
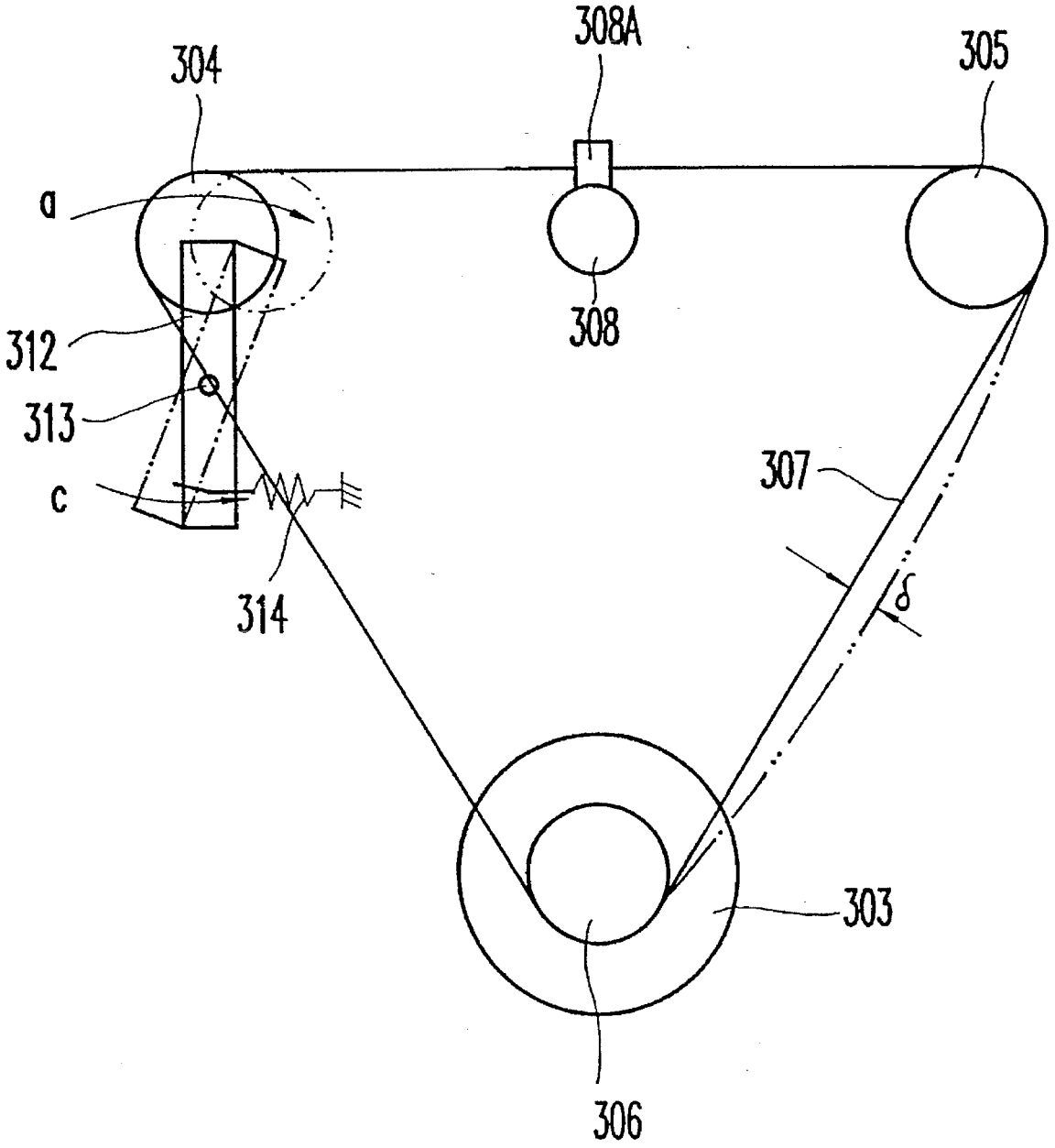
FIG. 12 is a schematic view showing condition of a wire according to operation of the sheet jogging device.

FIG. 12 is schematic plane view showing a condition of the wire and the first driven pulley according to the movement of the alignment rod. When the alignment rod 308 endures the predetermined overload, the bracket 312 is pivotally rotated on a pin 313 of the support member 311 to the direction of "a" by the tension of the wire 308 as shown in FIGS. 10 and 12. Accordingly, the spring 314 fixed at the other end of the bracket 312 is extended to the direction of "c". In accordance with the rotation of the bracket 312, a distance between the first driven pulley 304 and the second driven pulley 305 is decreased gradually. Finally, when the copy sheets P are completely aligned, the wire 307 becomes loosed (relaxing displacement δ a shown in FIG. 12). This is because when the copy sheets P contact the support rod 315 by the alignment rod 308, the alignment rod 308 stops but the wire 307 is rotated a little further and the tensile force pulls the first driven pulley 304 inwardly and the locational change of the first driven pulley 304 looses the wire between the driving pulley 303 and the second driven pulley 305 by δ. At a result, a driving force of the drive means 303 is not transmitted to the second driven pulley 305 and the driving pulley 306 rotates idle. Therefore, although the alignment rod 308 contacts with the copy sheets P, no load is applied to the drive means 303.

When the operation of the drive means 303 is stopped after completion of alignment of the copied sheets P, the expanded spring 314 is restored to the initial condition and the bracket 312 and the first driven pulley 304 return to the initial positions, so that the loosed wire 307 is fastened to the initial condition. Then drive means 303 is operated in reverse and the alignment rod 308 returns to the initial position shown in FIG. 11A. Using a wire instead of gears as a power transmission means, the sheet jogging device makes no noise in operation. Also, loosening the wire 307 responding to the predetermined contact force between the copy sheets and the alignment rod 308 when the operation is completed, overload is not applied to the drive means 303.

A stapling device according to the present invention will be described.

Figure 13:
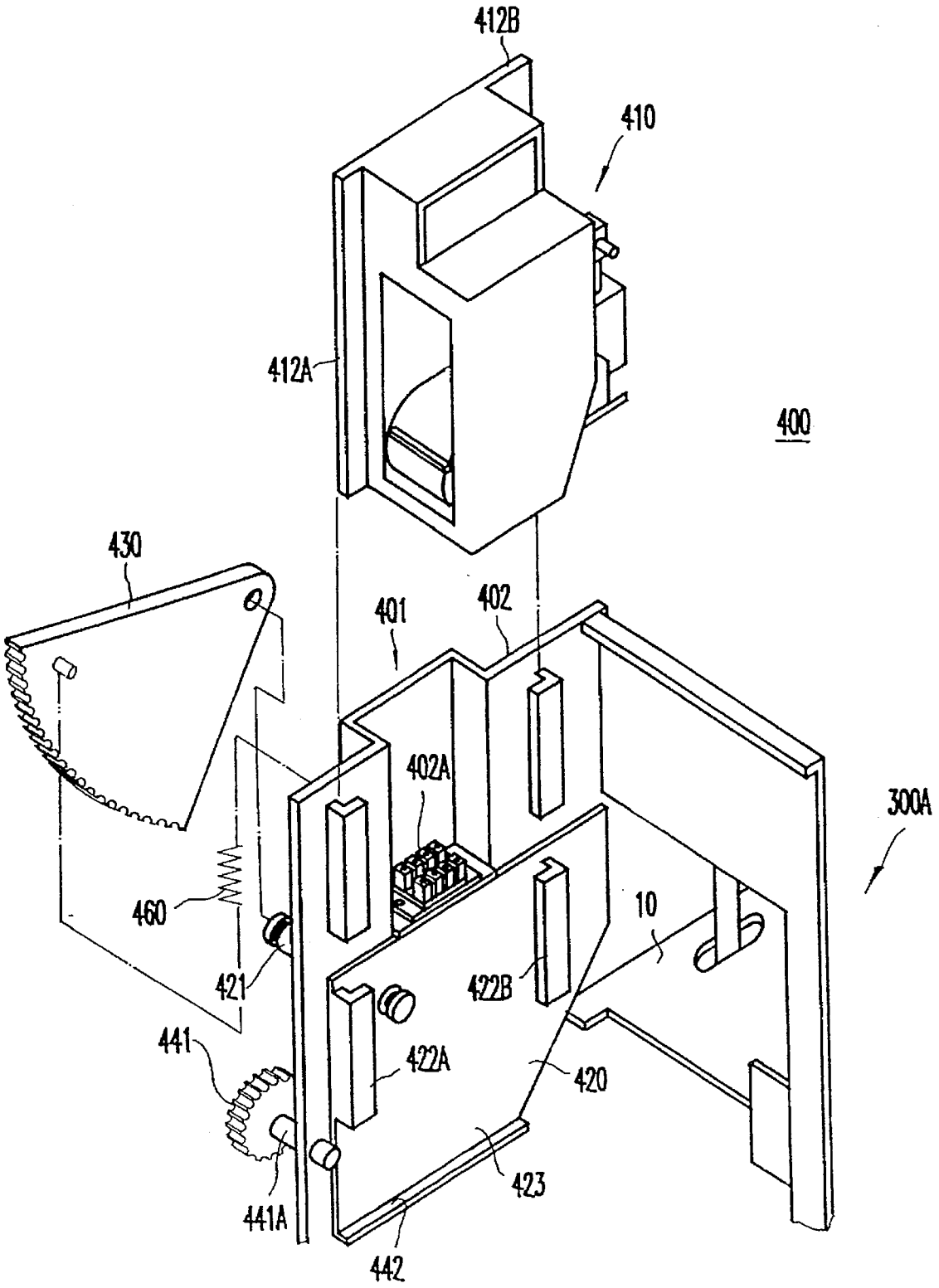
FIG. 13 is an exploded perspective view of a stapling device according to the invention.

FIG. 13 is an exploded perspective view of a stapling device according to the present invention. The stapling device 400 is located at a lateral side of the outlet part (300A in FIG. 9) as partially shown in FIG. 1. The stapling device 400 comprises a stapler assembly 410, stapler attaching portion 401 of the side wall of the outlet part, a guide plate 420 pivoted rotationally to the stapler attaching part 401, a driven sector gear 430 securely fixed to the guide plate 420 and a driving gear 441 driven by the drive part (not shown) and geared with the driven sector gear 430.

The stapler assembly 410 is installed inside the side wall near and behind the rear end of the tray 10 and the guide plate 420, on which the stapler assembly 410 can be attached and detached, is pivoted rotationally to the stapler attaching part 402 of the inner side wall with a pivotal shaft 421 which is extended outwardly. The stapler assembly 410 is attached on the guide plate 420 with its wings 412A and 412B inserted in guide grooves 422A and 422B of the guide plate 420. A pair of grooves 422A and 422B are formed with a pair of oppositely and inwardly bent members on the guide pate 420, and a support bar 423 is provided on the lower end of the guide plate 420 in order to retain the stapler assembly 410 on the guide plate 420 in cooperation with the guide grooves 422A and 422B. The stapler assembly 410 has a pair of opposed extended wings 412A and 412B at both side edges which is inserted into the guide grooves 422A and 422B.

The driven sector gear 430 is securely fixed to the other end of the pivotal shaft 421 extended from the side wall portion 402 with one end fixed to the guide plate 420. The sector gear 430 is geared with the driving gear 441 fixed to an extended end of a driving shaft 441A which is also extended through the side wall portion 402.

A tension spring 460, which returns the guide plate 420 to the initial position, is fixed to the upper part of the side wall portion 402 with one end and is also fixed to the sector gear 430 with the other end.

Figure 14:
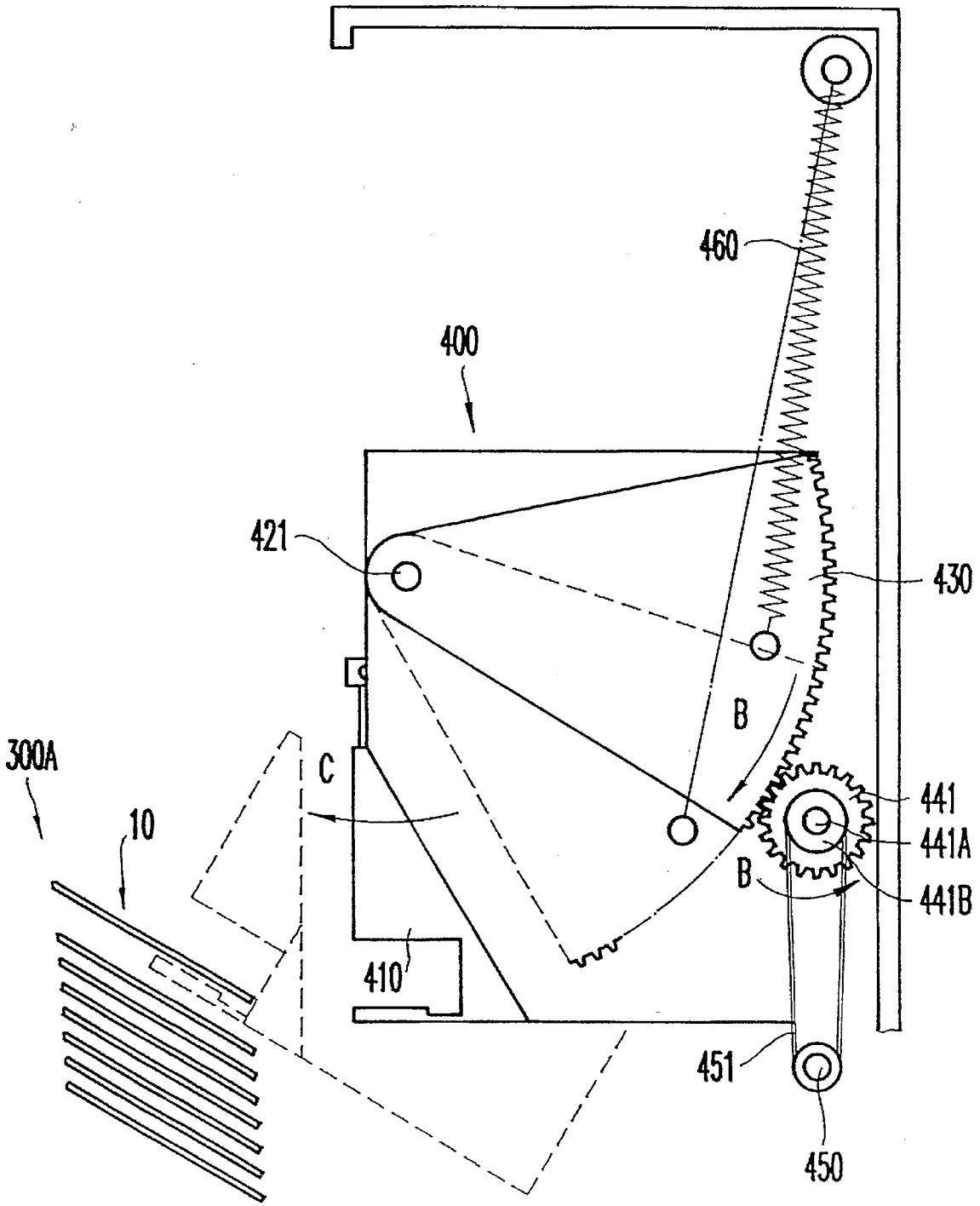
FIG. 14 is a schematic view of a stapling device showing operation of a stapler assembly.

FIG. 14 is a side elevational view of the assembly of the members as shown in FIG. 13. The stapler assembly 410 is installed on the guide plate 420 by sliding the edge wings 412A and 412B into the guide grooves 422A and 422B till the lower end of the stapler assembly 410 is in contact with the support bar 423 of the guide plate 420. Then, terminals (not shown) from the stapler assembly 410 are connected to terminals 402A mounted at the side wall portion 402.

The sector gear 430 is securely fixed to one end of the pivotal shaft 421 extended outwardly from the guide plate 420 in which the other end of the shaft 421 is fixed, and this sector gear 430 is geared with the driving gear 441 installed rotationally at the side wall portion 402. Then a spring 460 is installed by fixing one end on the side wall portion 402 and fixing the other end on the outer part of the sector gear 430 as shown in FIG. 14. The sector gear 43 rotates clockwise ("B" direction in FIG. 14) when the driving gear 441 rotates counterclockwise ("B" direction in FIG. 14), then the guide plate 420 and the stapler assembly 410 which are connected to the sector gear 430 rotates in C direction pivoting on the shaft 421 and at the same time the spring 460 fixed to the sector gear 460 is resiliently expanded. The stapler assembly 410 is located vertically to the tray 10 when completely rotated, and staples the collated and aligned copy sheets as shown by the phantom lines in FIG. 14 (the stapler assembly may be one of various known staplers).

The stapler assembly 410 returns to the original position by the restoring force of the expanded spring 460 after completion of the stapling.

Figure 15:
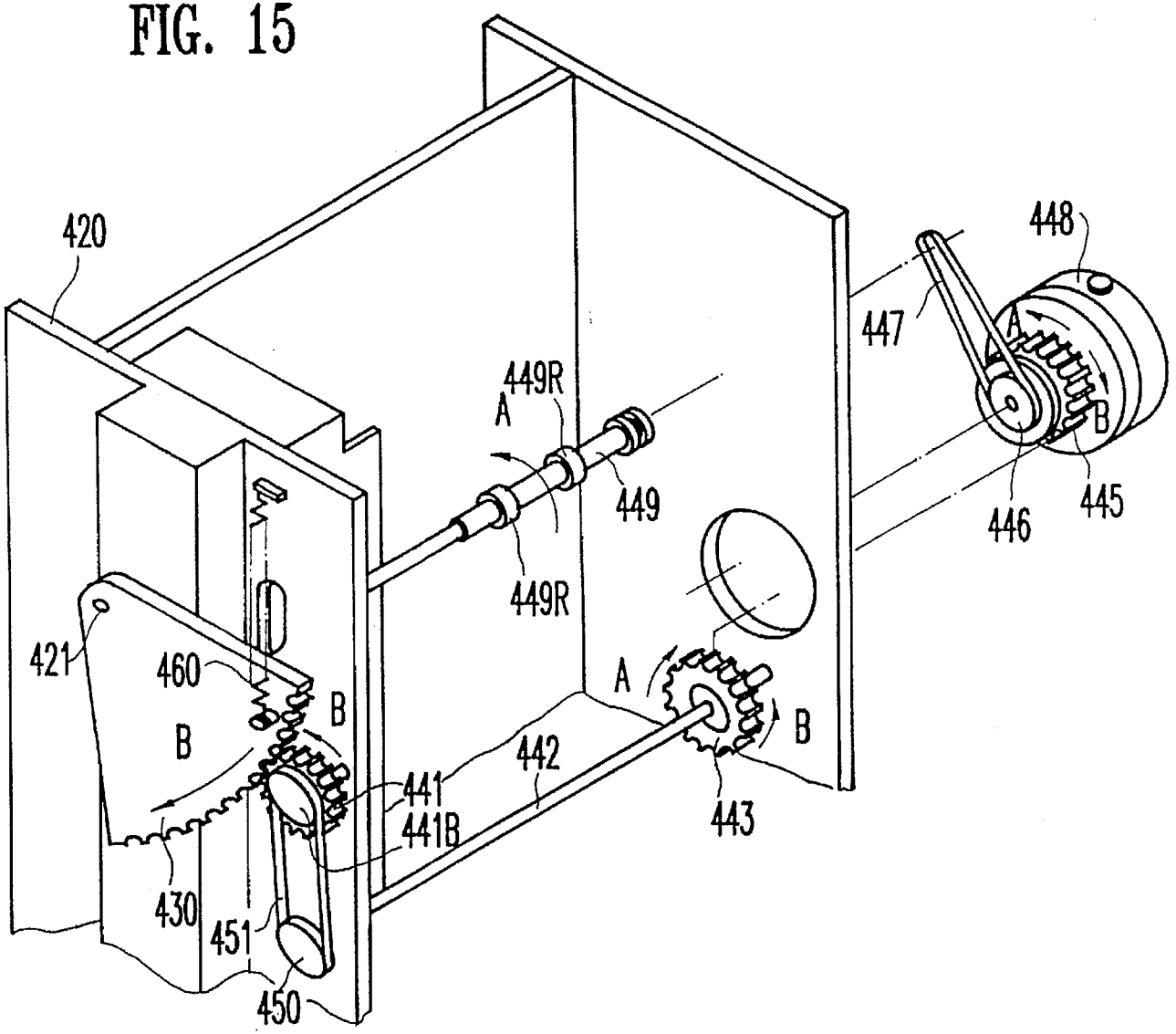
FIG. 15 is a perspective view of a drive means and a stapling device showing the driving mechanism of the stapling device.
Figure 16A:
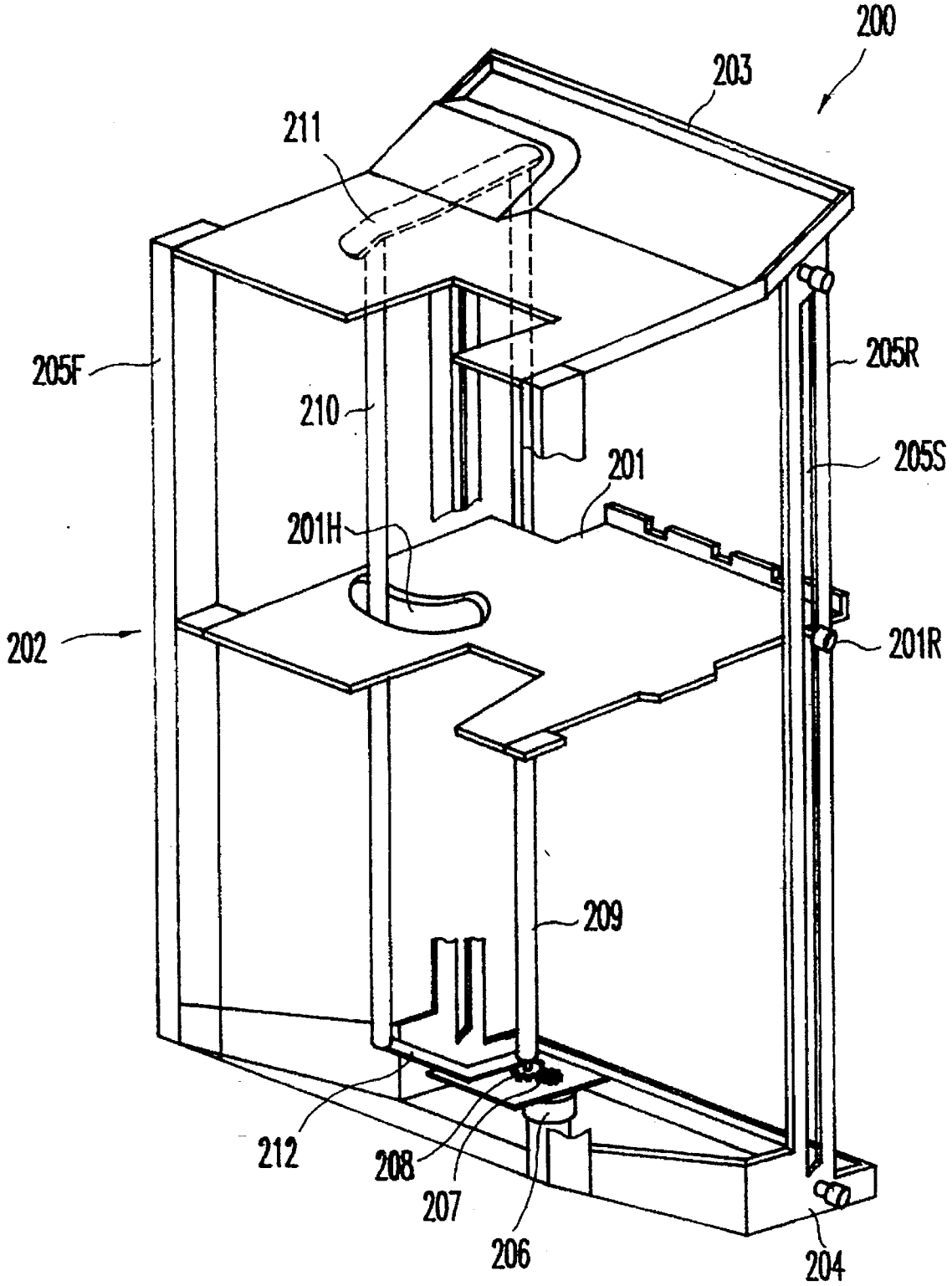
FIG. 16A (PRIOR ART)
FIG. 16A is a perspective view of a conventional sheet jogging device.
Figure 16B:
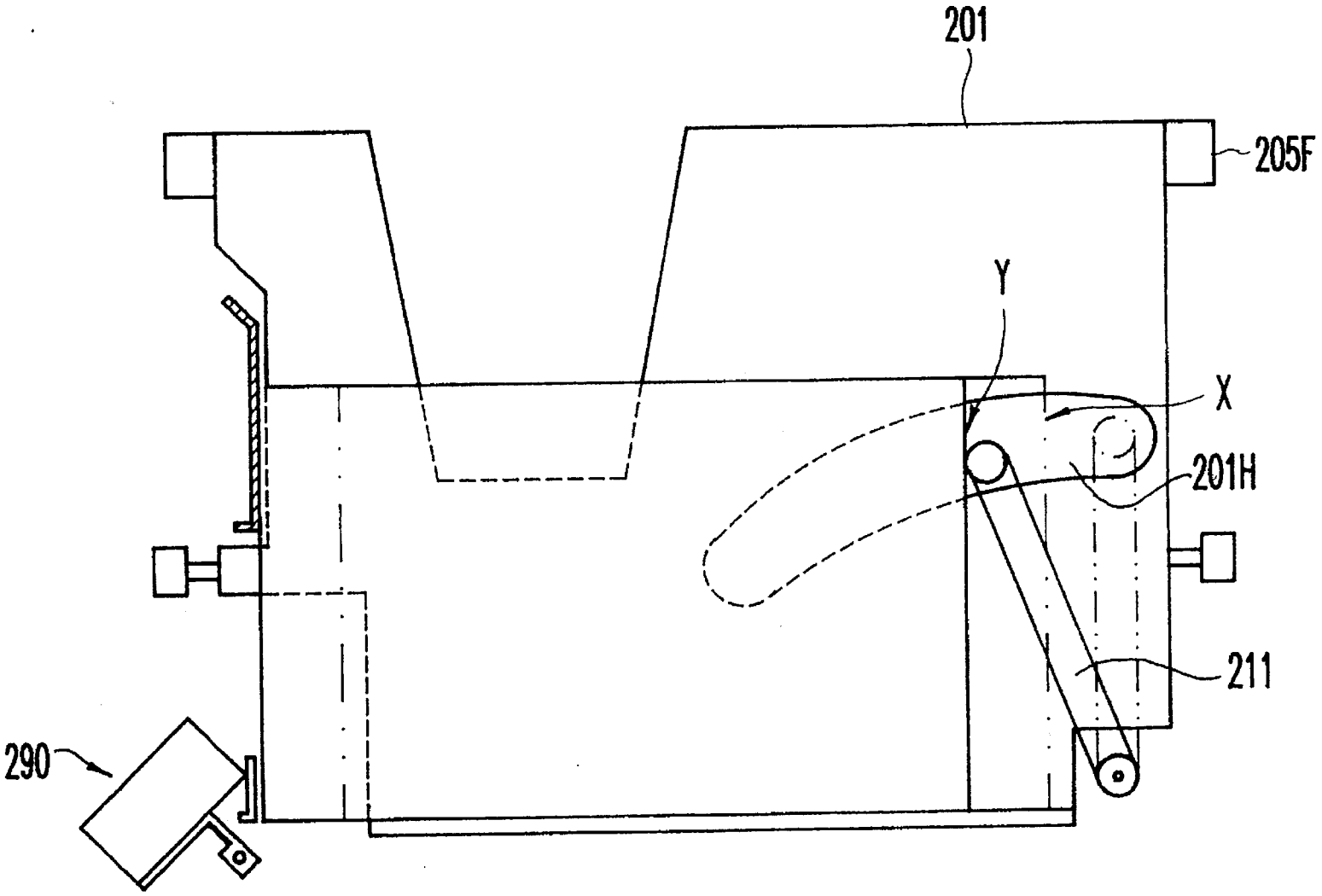
FIG. 16B (PRIOR ART)
FIG. 16B is a plane view of FIG. 16A.

FIG. 15 is a partially perspective view showing the drive means, the driving gear and the driven sector gear of the stapling device. The drive means 448 for the stapling device uses the motor 448 driving the sheet discharging roller, the motor 448 drives, through a pulley 446 and a belt 447, a roller driving shaft 449 equipped with sheet discharging roller (the discharging process in copying machine has already been known, so the detailed explanation is omitted herewith).

A motor which can be rotated selectively in both directions, is adopted as the sheet discharging motor in this invention in order to accomplish the stapling function as well as sheet discharging function. As the sheet discharging motor is generally stopped after copy sheets are distributed, the motor can be used as a drive means for the stapling device by reversing the rotational direction of the motor and a separate rotation conversion means is adopted in order to transmit torque from the drive means to the stapling device selectively. The rotation conversion means is connected to a driving gear 445 of the motor 448. The illustrated embodiment adopts one-way clutch 443 as the rotation conversion means. The clutch 443 is geared with the driving gear 445 of the sheet discharging motor 448, and is connected to a power transmission pulley 450 through the driving shaft 442. The power transmission pulley 450 is connected to the driving gear 441 via a belt 451. Accordingly, the driving gear 441 has a pulley 441B as an integrated part thereof in order to be connected with the power transmission pulley 450 via the belt 451.

When the sheet discharging process is operated (the motor 448 rotates in A direction of FIG. 15), the roller driving shaft 449 and the roller 449R rotate in A direction to transport copy sheets to the trays. At this time, the driving gear 445 and the one-way clutch 443 also should rotate in A direction. However, one-way clutch 443 is set to work when rotating only in one direction, "B" direction in this case, so that during the sheet discharging process, the clutch 443 would not transmit torque to the shaft 442 but idle (rotate by itself). Therefore, the stapling device is not operated.

When the motor 448 is reverse driven (rotation in B direction) for stapling the copy sheets after completing the sheet discharging process, the one-way clutch 443 rotates in "B" direction to transmit torque to the shaft 443, so that the stapling device is activated while the roller shaft 449 is idle. Then the sector gear 430 rotates in B direction pivoting on the shaft 421 in accordance with the rotation of the driving gear 441 in B direction, and therefore the stapler assembly 410 rotates in C direction and staples the sheets aligned at the rear end of the tray as shown in FIG. 14.

When the stapler assembly 410 is rotated in C direction and comes to the stapling position, the motor 448 stops but the one-way clutch 443 is locked with the shaft 443 in the transmission mode. Therefore, the sector gear 430 cannot rotate in C direction in spite of the restoring force of the spring 460 and the stapler assembly 410 serves to staple the sheets in a stable condition. After stapling, the one-way clutch is unlocked by the rotation of the motor 448 in A direction, and the stapler assembly 410 returns to the original position by the restoring force of the spring 460. In the return process, the driving gear 441 geared with the sector gear 430 rotates in the reverse direction from B and the shaft 442 and the one-way clutch 443 is supposed to rotate the driving gear 445 in A direction but the clutch 443 actually stops since the clutch 443 is set to transmit torque only in B direction and the one-way clutch 442 has been unlocked by the rotation of the motor 448 in A direction, so that the shaft 442 is idle rotating in the clutch 443. Therefore, no torque from the return process is transmitted to the motor 448, so that no load is applied to the motor 448 (the direction of the driving torque from the motor, of course, may be reversed by changing the hooking methods of the belt which connects the transmission pulley 450 to the pulley 441B of the driving gear 441).

The stapling device according to the invention has the following advantages. As the stapler assembly 410 can be easily attached on or detached from the guide grooves (422A and 422B) on the guide plate 420, the operator can supply staples to the stapler assembly and resolve defects, for example, jams, with great ease and convenience. This invention also provides an economic and compact stapling device due to the effective use of the sheet discharging motor 448 as a drive means without installing a separate drive means.

The tray shifting type sorter, the sheet jogging device and the stapling device as explained above can be integrated in a sorter in order to provide a stapling sorter.

Many modifications and variations may be made in the techniques and structure described and illustrated herein without departing from the spirit and scope of the present invention. Accordingly, it should be understood that the techniques and structures described and illustrated herein are illustrative only and are not to be considered as limitations upon the scope of the present invention.

What is claimed is:

1. A sorter for a copying machine, said sorter comprising a plurality of trays 10 having a couple of trunnions 30 and 35 at rear opposite lateral ends;

a tray supporter 80 for stacking said trays 10 thereon;

a pair of side walls 120 having a couple of vertical slots 121 and 122 having through holes 123 and 124 at the outlet into which said trunnions 30, 35 are inserted;

a pair of drive wheel assemblies 100 which are installed opposite said through holes 123 and 124 of said side walls 120 which shift said trunnions 30 and 35 along said through holes 123 and 124; wherein the drive wheel assembly 100 includes a cam wheel 101 and a supplementary wheel 102 cooperated with the cam wheel 101, the cam wheel having a slot 101B through which the first trunnion 30 of said tray 10 passes as said supplementary wheel 102 having at least one cam surface 102D which supports the second trunnion 35 of the tray 10; and a pair of tension springs 126 having one end fixed to upper part of said side wall and the other end fixed to said tray supporter 80, which ascend said trays 10 and said supporter 80 along vertical holes 125 formed at lower part of said side wall 120.

2. A sorter for a copying machine, said sorter comprising:

a plurality of trays 10 having a couple of trunnions 30 and 35 at rear opposite lateral ends;

a tray supporter 80 for stacking said trays 10 thereon;

a pair of side walls 120 having a couple of vertical slots 121 and 122 having through holes 123 and 124 at the outlet into which said trunnions 30, 35 are inserted;

a pair of drive wheel assemblies 100 which are installed opposite said through holes 123 and 124 of said side walls 120 which shift said trunnions 30 and 35 along said through holes 123 and 124;

a pair of tension springs 126 having one end fixed to upper part of said side wall and the other end fixed to said tray supporter 80, which ascend said trays 10 and said supporter 80 along vertical holes 125 formed at lower part of said side wall 120; and a tray cover 90 having a pair of restraining means 92 which are extended from the rear lateral end of said cover 90 toward the trunnions 30 and 35 and a connecting member 91 which connects said cover 90 to the tray supporter 80.

3. A sorter for a copying machine, said sorter comprising:

a plurality of trays 10 having a couple of trunnions 30 and 35 at rear opposite lateral ends;

a tray supporter 80 for stacking said trays 10 thereon;

a pair of side walls 120 having a couple of vertical slots 121 and 122 having through holes 123 and 124 at the outlet into which said trunnions 30, 35 are inserted;

a pair of drive wheel assemblies 100 which are installed opposite said through holes 123 and 124 of said side walls 120 which shift said trunnions 30 and 35 along said through holes 123 and 124;

a pair of tension springs 126 having one end fixed to upper part of said side wall and the other end fixed to said tray supporter 80, which ascend said trays 10 and said supporter 80 along vertical holes 125 formed at lower part of said side wall 120; and a pair of guide members 40 having a plurality of guide holes 41 and a plurality of trays 10 having further a pair of guide pins 20 oppositely and respectively to be inserted into said guide holes 41, wherein said guide pin 20 has a boss 21, said boss having a diameter substantially the same as the distance between adjacent guide holes.

4. The sorter as claimed in claim 3, characterized in that the guide pin 20 has an enlarged end portion 22 at the free end and the guide hole 41 has an insertion hole 42 which is slightly larger than the enlarged end portion and is formed at the lower end of the guide hole 41, wherein said enlarged end portion 22 is inserted into said insertion hole 42 when the guide pin 20 is mated with the guide hole 41 so that the enlarged portion 22 prevents the guide pin 20 being disassembled from the guide hole 41 by accident.

5. The sorter as claimed in claim 3, characterized in that a tray comprises a tray member 50 having a pair of opposing guide pin connection parts 51 and a pair of opposing trunnion connection parts 53, a pair of guide pin portions 60 having a guide pin 61 respectively on one side and a couple of resilient members 64 and 65 on the other side, and a pair of trunnion portions 70 having a pair of trunnions 71 and 73 on one side and a couple of resilient members 78 and 79 on the other side, wherein said guide pin portions 60 are connected to said guide pin connection parts 51 and said trunnion portions 70 are connected to said trunnion connection parts 53.

6. The sorter as claimed in claim 5, characterized in that the guide pin connection parts 51 and the trunnion connection parts 53 have a through hole 52 and 54 respectively, and the guide pin portion 60 and the trunnion portion 70 have a latching protrusion 66 and 76 respectively which is latched in said through hole 52 and 54 and is extended from one resilient member toward the other resilient member, said latching protrusions 66 and 76 having an inclined surface 66B and 76B toward the diverged ends of the resilient members and a vertical surfaces 66A and 76A at the opposing side of the inclined surface.

7. The sorter as claimed in claim 1, characterized in that the slot 101B of the cam wheel 101 is formed curvilinearly in the middle of the inner surface and has an entry 101E and an exit 101F radially and oppositely, and the through holes 123 and 124 are inclined toward the trays 10.

8. The sorter as claimed in claim 1, characterized in that one supplementary wheel 102 of the drive wheel assembly 100 in the driving side is driven via a timing belt 104 directly by a motor 105 and the other supplementary wheel 102 of the drive wheel assembly 100 in the driven side is driven by the horizontal shaft 109 connecting said one supplementary wheel 102 of the driving side and said other supplementary wheel 102 of the driven side.

9. The sorter as claimed in claim 8, characterized in that the cam wheel 101 and the supplementary wheel 102 of the driving wheel assembly 100 are cooperated by a gear wheel 103.

10. The sorter as claimed in claim 9, characterized in that the gear wheel 103 is fixed to the supplementary wheel 102 and the gear wheel 103 is geared with gear part 101A of the cam wheel 101.

11. The sorter as claimed in claim 9, characterized in that the gear wheel 103 and the supplementary wheel 102 are fixed by a groove on one wheel and a protrusion part on the other wheel.

12. The sorter as claimed in claim 10, characterized in that the supplementary wheel 102 has a couple of cam surfaces 102D and a couple of recesses 102E alternately, and the gear ratio between the gear part 101A of the cam wheel 101 and the gear wheel 103 is 1:2.

13. The sorter as claimed in claim 12, characterized in that the gear wheel 103 has a pair of arc protrusions 103D oppositely in the outer surface and an encoder 16 is installed sensing the openings between said arc protrusions 103D.

14. A sheet jogging device for aligning copy sheets comprising:

a plurality of trays 10 having a oblique hole, respectively;

a drive means 303 having a driving pulley 306, which is installed on a tray support plate 302;

a first driven pulley 304 and a second driven pulley 305 which are installed rotationally on the tray support plate 302 and are connected with said driving pulley 306 via a power transmission means;

a tension change means 320 which changes the tension of said power transmission means by moving the first driven pulley 304; and an alignment rod 308 which is inserted vertically into the oblique holes 10A of said trays 10 and moved by said power transmission means within said oblique holes 10A, wherein said drive means 303 moves said alignment rod 308 to align copy sheets and the predetermined contact force between said alignment rod 308 and the copy sheets activates said tension change means to prevent said drive means from being overloaded by loosening the power transmission means.

15. The sheet jogging device as claimed in claim 14, characterized in that the power transmission means is a wire 307 which encircles the pulleys 304, 305 and 306 therearound.

16. The sheet jogging device as claimed in claim 15, characterized in that the alignment rod 308 has a wire fixing member 308A so that the wire 307 moves said alignment rod 308.

17. The sheet jogging device as claimed in claim 14, further characterized by a pair of guide rails 309A and 309B mounted on the tray support plate 302, and the alignment rod 308 having a base 310 at the lower end having a pair of bushings 310A and 310B which slide on said guide rails 309A and 309B.

18. The sheet jogging device as claimed in claim 14, characterized the tension change means 320 comprises a support member 311 fixed on the tray support plate 302; a bracket 312 on which the first driven pulley 304 is mounted at one end and which is mounted rotationally on the support member 311 pivoted on a pin 313; and a spring 314 which is fixed to the other end of the bracket 312 with one end and is fixed to the tray support plate 302 with the other end, wherein the tension change means 320 rotates said bracket 312 pivotally and inwardly from the power transmission means, so that the first driven pulley 304 changes the location loosening the encircled power transmission means.

19. A stapling device for stapling the sorted and aligned copy sheets comprising:

a stapler assembly 410;

a guide plate 420 fixed to the inner surface of the side wall portion 402, the guide plate 420, on which said stapler assembly 410 can be attached and detached, rotating pivotally toward the trays 10;

a driven sector gear 430 which is fixed to said guide plate 420 and rotates said guide plate 420;

a drive means 448 which transmits torques to sheet discharging roller shaft 449;

a rotation switching means which selectively transmits torques from said drive means 448 to said sector gear 430; and a return means which returns the pivotally rotated sector gear to the initial position, wherein when copy sheets are aligned, the rotation switching means transmits torques from the drive means to said sector gear 430, so that said guide plate 420 and said stapler assembly 410 rotates toward the trays to staple the aligned copy sheets.

20. The stapling device as claimed in claim 19, characterized in that the stapler assembly 410 has a pair of wings 412A and 412B and the guide plate 420 has a pair of guide grooves 422A and 422B oppositely on the surface, which guide and receive the wings 412A and 412B of the stapler assembly 410 therein.

21. The stapling device as claimed in claim 19, characterized in that the guide plate 420 further includes a horizontal bar 423 at the lower end, which contacts and supports the lower end of the stapler assembly 410.

22. The stapling device as claimed in claim 19, characterized in that the guide plate 420 is fixed to the sector gear 430 by a shaft 421 which is rotationally installed passing through the side wall portion 402 and is fixed to the guide plate 420 with one end and is fixed to the sector gear 430 with the other end.

23. The stapling device as claimed in claim 19, characterized in that said rotation switching means comprises a driving gear 445; an one-way clutch 443 geared with said driving gear 445; a driving shaft 442 which is connected to said one-way clutch 443 with one end and connected to a toque transmission pulley 450 with the other end; and a driving gear 441 geared with the sector gear 430, wherein said one-way clutch 443 cuts off torques transmission when the drive means 448 drives the sheet discharging roller shaft, and transmits torques to the sector gear 430 when stapling.

24. The stapling device as claimed in claim 23, characterized in that when stapling operation is completed, the drive means is reversely activated in order to unlock the one-way clutch.

25. The stapling device as claimed in claim 19, characterized in that the return means comprises a spring 460 which is fixed to the sector gear 430 with one end and is fixed to the side wall portion 402 with the other end, wherein when the stapling operation is completed, the spring 460 returns the sector gear 430 to the initial position by the restoring force thereof.

26. A stapling sorter comprising:

a sorter comprising a plurality of trays 10 having a couple of trunnions 30 and 35 at rear opposite lateral ends, a tray supporter 80 for stacking said trays 10 thereon, a pair of side walls 120 having a couple of vertical slots 121 and 122 having through holes 123 and 124 at the outlet into which said trunnions 30 and 35 are inserted, a pair of drive wheel assemblies 100 which are installed opposite said through holes 123 and 124 of said side walls 120 which shift said trunnions 30 and 35 along the said through holes 123 and 124, and a pair of tension springs 126 having one end fixed to upper part of said side wall and the other end fixed to said tray supporter 80, which ascend said trays 10 and said supporter 80 along vertical holes 125 formed at lower part of said side wall 120;

a sheet jogging device for aligning the sorted copy sheets, comprising a plurality of trays 10 having a oblique hole, respectively, a drive means 303 having a driving pulley 306, which is installed on a tray support plate 302, a first driven pulley 304 and a second driven pulley 305 which are installed rotationally on the tray support plate 302 and connected with said driving pulley 306 via a power transmission means, a tension change means 320 which changes the tension of said power transmission means by moving the first driven pulley 304, and an alignment rod 308 which is inserted vertically into the oblique holes 10A of said trays 10 and moved by said power transmission means within said through holes 10A, wherein said drive means 303 moves said alignment rod 308 to align copy sheets and the predetermined contact force between said alignment rod 308 and the copy sheets activates said tension change means to prevent said drive means from being overloaded by loosening the power transmission means; and a stapling device for stapling the sorted and aligned copy sheets, comprising a stapler assembly 410, a guide plate 420 fixed to the inner surface of the side wall portion 402, the guide plate 420, on which said stapler assembly 410 can be attached and detached, rotating pivotally toward the trays 10, a driven sector gear 430 which is fixed to said guide plate 420 and rotates said guide plate 420, a drive means 448 which transmits torque to sheet discharging roller shaft 449, a rotation switching means which selectively transmits torques from said drive means 448 to said sector gear 430; and a return means which returns the pivotally rotated sector gear to the initial position, wherein when copy sheets are aligned, the rotation switching means transmits torques from the drive means to said sector gear 430, so that said guide plate 420 and said stapler assembly 410 rotates toward the trays to staple the aligned copy sheets.

* * * * *